US006872927B2

(12) United States Patent
Geisler et al.

(10) Patent No.: US 6,872,927 B2
(45) Date of Patent: Mar. 29, 2005

(54) SYSTEMS AND METHODS FOR PROCESSING PATHOGEN-CONTAMINATED MAIL PIECES

(75) Inventors: William L. Geisler, Lake Oswego, OR (US); Howard M. Reisner, Durham, NC (US); Richard S. Garard, Chapel Hill, NC (US)

(73) Assignees: Lambda Technologies, Inc., Morrisville, NC (US); The University of North Carolina at Chapel Hill, Chapel Hill, NC (US)

( * ) Notice: Subject to any disclaimer, the term of this patent is extended or adjusted under 35 U.S.C. 154(b) by 27 days.

(21) Appl. No.: 10/217,710

(22) Filed: Aug. 12, 2002

(65) Prior Publication Data

US 2003/0132227 A1 Jul. 17, 2003

Related U.S. Application Data

(60) Provisional application No. 60/344,619, filed on Dec. 26, 2001.

(51) Int. Cl.[7] ..... H05B 6/78

(52) U.S. Cl. ..... 219/700; 219/680; 250/492.1; 232/31

(58) Field of Search ..... 219/700, 678, 219/756, 717, 762, 725; 422/1, 3, 21, 28, 31, 32, 40, 119, 256, 186, 2, 29, 300; 232/17, 19, 30, 31; 250/492.1; 73/803.22

(56) References Cited

U.S. PATENT DOCUMENTS

| | | | | |
|---|---|---|---|---|
| 3,660,234 A | 5/1972 | Gray | ..... | 195/1.2 |
| 3,753,651 A | 8/1973 | Boucher | ..... | 21/54 |
| 3,926,556 A | 12/1975 | Boucher | ..... | 21/54 |
| 4,188,375 A | 2/1980 | Straub | ..... | 424/88 |

(Continued)

FOREIGN PATENT DOCUMENTS

| | | | |
|---|---|---|---|
| CA | 1222563 | 6/1987 | ..... H01J/25/06 |
| CA | 1248348 | 1/1989 | ..... F26B/3/34 |
| CA | 1293943 | 1/1992 | ..... C10G/1/00 |
| CA | 2009782 | 8/2002 | ..... E21B/43/00 |
| EP | 0 217 662 B1 | 1/1994 | ..... A61L/2/12 |
| WO | WO 96/09843 | 4/1996 | ..... A61M/1/26 |
| WO | WO 98/57523 | 12/1998 | ..... H05B/6/64 |

OTHER PUBLICATIONS

Latimer and Matsen, "Microwave Oven Irradiation as a Method for Bacterial Decontamination in a Clinical Microbiology Laboratory," *Journal of Clinical Microbiology,* vol. 6, Oct. 1977, pp. 340–342.

(Continued)

*Primary Examiner*—Quang T. Van
(74) *Attorney, Agent, or Firm*—Myers Bigel Sibley & Sajovec, P.A.

(57) ABSTRACT

Systems and methods for neutralizing pathogen-contaminated mail pieces via variable frequency microwave processing are provided. Mail pieces are initially screened to identify suspicious characteristics or indications of potentially harmful contents. Mail pieces are swept with variable frequency microwaves selected to neutralize pathogens contained within each mail piece without harming the mail piece or other contents thereof. The temperature of each mail piece may be monitored during microwave processing to identify mail pieces containing potentially harmful substances and/or devices. Mail pieces can be irradiated via additional forms of radiation to neutralize pathogenic material on outside surfaces thereof.

140 Claims, 12 Drawing Sheets

U.S. PATENT DOCUMENTS

| | | | | |
|---|---|---|---|---|
| 4,250,139 | A | 2/1981 | Luck et al. | 422/21 |
| 4,839,142 | A | 6/1989 | Charm | 422/21 |
| 4,861,956 | A | 8/1989 | Courneya | 219/10.55 |
| 4,880,512 | A | 11/1989 | Cornelius et al. | 204/157.61 |
| 4,975,246 | A | 12/1990 | Charm | 422/21 |
| 5,073,167 | A | 12/1991 | Carr et al. | 604/114 |
| 5,539,673 | A | 7/1996 | Charm et al. | 364/557 |
| 6,092,301 | A | 7/2000 | Komansky | 34/263 |
| 6,268,200 | B1 | 7/2001 | Tucker et al. | 435/236 |
| 6,303,316 | B1 | 10/2001 | Kiel et al. | 435/6 |
| 2003/0124025 | A1 * | 7/2003 | Mize et al. | 422/28 |
| 2003/0132279 | A1 * | 7/2003 | Stemmle | 232/31 |
| 2003/0132398 | A1 * | 7/2003 | Wang | 250/492.1 |
| 2003/0145664 | A1 * | 8/2003 | Schwarz et al. | 73/863.22 |
| 2004/0022665 | A1 * | 2/2004 | Lu | 422/1 |

OTHER PUBLICATIONS

Jeng, Kaczmarek, Woodworth and Balasky, "Mechanism of Microwave Sterilization in the Dry State," *Applied and Environmental Microbiology,* Sep. 1987, vol. 53, No. 9, pp. 2133–2137.

(Abstract) Szmigielski et al., *In vitro and in vivo inhibition of virus multiplication by microwave hyperthermia* The Excerpta Medica Database No. 78039052, Archives of Virology, vol. 53, No. 1–2, pp. 71–77 (1977).

Kohli et al., *Calculated Microwave Absorption of Double–Helical B–Conformation Poly (dG) Poly (dC)*, Biopolymers, vol. 20, pp. 853–864 (1981).

(Abstract) Sanborn et al., *Microwave sterilization of plastic tissue culture vessels for reuse—tested against 9 bacterial cultures including Bacillus also polio and parainfluenza virus and phage,* Dialog Select, Appl.Environ.Microbiol. 44, pp. 960–64 (1982).

Van Zandt et al., *Communications to the Editor, Absorption of Microwave Radiation by DNA Double Heliz in aquo,* Biopolymers, vol. 21, pp. 1465–1468 (1982).

Swicord et al., *Microwave Absorption of DNA Between 8 and 12 GHZ,* Biopolymers, vol. 21, pp. 2453–2460 (1982).

(Abstract) Vasl et al., *Virus behavior in irradiated sludge,* EMBASE No. 83220032, Water Sci. Technol. 15/5, pp. 123–27 (1983).

Hakim et al., *The Speed of Sound in DNA,* Biopolymers, vol. 23, pp. 1185–1192 (1984).

de Xammar Oro et al., *Dielectric Properties of Aqueous Solutions of Sonicated DNA above 40 MHz,* Biopolymers, vol. 23, pp. 1457–1463 (1984).

Edwards, *Microwave–Field Driven Acoustic Modes in Selected DNA Molecules,* Dissertation, Graduate School of the University of Maryland (1984).

Bonincontro et al., *Effect of Ions on Counterion Fluctuation in Low–Molecular Weight DNA Dielectric Dispersions,* Biophysical Society, vol. 45, pp. 495–501 (Mar. 1984).

Takashima et al., *Dielectric Behavior of DNA Solution at Radio and Microwave Frequencies (at 20° C.)*, Biophysical Society, vol. 46, pp. 29–34 (Jul. 1984).

(Abstract) K. Buckel, *A Study of the Effects of Microwave Energy on Plant Viruses,* Dialog Select, Trans. Kans. Acad. Sci., 88 (3–4), pp. 138–143 (1985).

Horowitz et al., *Inactivation of viruses in labile blood derivatives,* Transfusion, vol. 25, No. 6, pp. 523–527 (1985).

Edwards et al., *Microwave Field Driven Acoustic Modes in DNA,* Biophysical Society, vol. 47, pp. 799–807 (Jun. 1985).

Davis et al., *Direct Excitation of Internal Modes of DNA by Microwaves,* Bioelectrochemistry & Biomagnetic, vol. 16, pp. 63–76 (1986).

Sagripanti et al, *Rapid communication, DNA structural changes caused by microwave radiation,* Int. J. Radiat. Biol. vol. 50, No. 1, pp. 47–50 (1986).

Bonincontro et a., *Temperature Dependence of Dielectric Constant at 10 GHz of Na–DNA Gels,* Biopolymers, vol. 25, pp. 241–247 (1986).

Sagripanti et al., *Microwave Effects on Plasmid DNA,* Radiation Research 110, pp. 219–231 (1987).

Tao et al., *The Dynamics of the DNA Hydration Shell at Gigahertz Frequencies,* Biopolymers, vol. 26, pp. 171–188 (1987).

Gabriel et al., *Microwave absorption in aqueous solutions of DNA,* Nature, vol. 328, pp. 145–146 (Jul. 1987).

Foster et al., *"Resonances" in the Dielectric Absorption of DNA*? Biophysical Society, vol. 52, pp. 421–425 (Sep. 1987).

Kaeser, *Ways to Reduce the Risk of Transmission of Viral Infections by Plasma and Plasma Products,* International Forum, pp. 228–245 (1988).

Bonincontro et al., *DNA–protamine interactions studies by dielectric and optical measurements,* 627th Meeting, Nottingham, vol. 17 (Jun. 1988).

Gabriel et al., *Dielectric behavior of aqueous solutions of plasmid DNA at microwave frequencies,* Biophysical Journal, vol. 55, pp. 29–34 (Jan. 1989).

(Abstract) Mishu et al., *Foodborne hepatitis A: Evidence that microwaving reduces risk*?, EMBASE No. 90272041, J. Infect. Dis. 162/3 (655–658) (1990).

(Abstract) Lange et al., *Japanese Encephalitis Virus JEV Potentiation of Lethality in Mcie by Microwave Radiation,* Dialog Select, Bioelectromagnetics, 12(6), pp. 335–348 (1991).

Pedone et al., *Temperature dependence of DNA dielectric dispersion at radiofrequency,* Biochimica et Biophysica Acta, pp. 580–584 (1991).

Charm et al., *High–Temperature Short–Time Heat Inactivation of HIV and Other Viruses in Human Blood Plasma,* Vox Sang, vol. 62, pp. 12–20 (1992).

Bernhardt, *Non–ionizing radiation safety: radiofrequency radiation, electric and magnetic fields,* Phys. Med. Biol., vol. 327, No. 4, pp. 807–844 (1992).

Quan et al., *Effects of Microwave Radiation on Anti–infective Factors in Human Milk,* Pediatrics, vol. 89 No. 4, pp. 667–669 (Apr. 1992).

Hart, H. et al., *Inactivation of Viruses during Ultraviolet Light Treatment of Human Intravenous Immunoglobulin and Albumin,* Vox Sang, vol. 64, pp. 82–88 (1993).

Morgenthaler, *Methods for inactivation of viruses in plasma products,* Biotechnology of Blood Proteins, vol. 227, pp. 221–228 (1993).

Bonincontro et al., *Influence of defects on the electrophoretic, thermodynamic and dielectric properties of a 21 base pair DNA in solution,* Biochimica et Biophysica Acta., 1171, pp. 288–294 (1993).

Hanson et al., *Gamma Radiation and Virus Inactivation,* Art to Science, vol. 12 No. 2 (Spring 1993).

Pothakamury et al., *Magnetic–Field Inactivation of Microorganism and Generation of Biological Changes,* Food Technology, pp. 85–93(Dec. 1993).

(Abstract) Hoffman et al., *Assessment of a Microwave–Based Clinical Waste Decontamination Unit*, Dialog Select, Journal of Applied Bacteriology, vol. 77, No. 6 (DEC) pp. 607–612 (1994).
(Abstract) Libertin et al., *Effects of gamma rays, ultraviolet radiation, sunlight, microwaves and electromegnetic fields on gene expression mediated by human immunodeficiency virus promoter,* EMBASE No. 94328378, Radiat. Res. 140/1, pp. 91–96 (1994).
(Abstract) Kakita et al., *Inactivation of Lactobacillus bacteriophage PL–1 by microwave irradiation,* Microbiol. Immunol. 39/8, pp. 571–576 (1995).
(Abstract) Kindle et al., *Killing activity of microwaves in milk,* EMBASE No. 96263719, J. Hosp. Infect., 33/4, pp. 273–278 (1996).
(Abstract) Taylor et al., *The response of the 22A strain of scrapie agent to microwave irradiation compared with boiling,* Neuropathol. Appl. Neurobiol., 22/3, pp. 256–258 (1996).
(Abstract) George, *Killing activity of microwaves in milk(1)*, EMBASE No. 97155578, J. Hosp. Infect., 35/4, pp. 319–320 (1997).
News Article, *RTP Company Explores Microwave Technology to Keep Mail Germ–Free,* WRAL.COM, Oct. 30, 2001.
News Article, *CEO Says Morrisville Company Can Use Microwaves to Kill Anthrax,* heraldsun.com, Oct. 20, 2001.
News Article, *Killing Anthrax, Company Suggest Irradiation Could Render Anthrax Harmless,* abcnews.com, Oct. 18, 2001.
Press Release, *Tests Show Advanced Microwave Technology Is New Weapon Against Anthrax.* Nov. 5, 2001.
Press Release, *Lambda Technologies VFM Anthrax Test Procedure,* Nov. 5, 2001.
Press Release, *The Classica Group to Conduct Tests Utilizing its Technology to Kill Bacteria and Spores in Mail as Well as in Packaged Food,* Business Wire, Oct. 23, 2001.

* cited by examiner

SYSTEMS AND METHODS FOR PROCESSING PATHOGEN-CONTAMINATED MAIL PIECES

RELATED APPLICATION

This application claims the benefit of U.S. Provisional Application No. 60/344,619, filed Dec. 26, 2001, the disclosure of which is incorporated herein by reference in its entirety as if set forth fully herein.

FIELD OF THE INVENTION

The present invention relates generally to mail processing and, more particularly, to mail processing systems and methods.

BACKGROUND OF THE INVENTION

Anthrax is an acute infectious disease caused by the spore forming bacterium *Bacillus anthracis*. Anthrax most commonly occurs in wild and domestic lower vertebrates (cattle, sheep, goats, camels, antelopes, and other herbivores), but it can also occur in humans when they are exposed to infected animals, tissue from infected animals, or any other source of anthrax spores. Human anthrax infection can occur in three forms: cutaneous (skin), inhalation, and gastrointestinal. *Bacillus anthracis* spores can live in the soil for many years, and humans can become infected with anthrax by handling products from infected animals or by inhaling anthrax spores from contaminated animal products. Anthrax can also be spread by eating undercooked meat from infected animals. If left untreated, anthrax in all forms can lead to septicemia and death.

By analogy with similar spore forming bacteria, a tough protective coat and a variety of other specific protective mechanisms including the presence of dipicolinic acid (possible as a complex with $Ca^{++}$), specific DNA stabilizing proteins, and an efficient DNA repair system allow anthrax bacteria to survive as spores for decades. Such spores are particularly dangerous when present in a state in which they can be easily aerosolized (dry and present as particles under about 5 microns in size).

Recent terrorism attacks in the U.S. and other countries have involved anthrax spores sent through the mail and have resulted in several deaths. The initial terrorist-related anthrax cases occurred among persons with known or suspected contact with opened letters containing anthrax spores. Subsequent anthrax cases have been confirmed among U.S. postal workers and others who have had no known contact with contaminated opened letters. This suggests that sealed envelopes containing anthrax spores passing through the postal system may be the source of anthrax exposure. The number of anthrax-contaminated mail pieces passing through the U.S. postal system to date is not known. It has been surmised that automated sorting and handling equipment utilized by postal services may have damaged mail pieces containing anthrax spores causing the release of anthrax spores into postal environments, or that sealed mail may be permeable to anthrax spores causing the release thereof into postal environments.

The U.S. Postal Service is currently investigating various strategies to address the risk of anthrax exposure among workers involved in mail handling. These strategies include providing workers with protective suits. Unfortunately, protective suits can be cumbersome and awkward to the wearer and may cause the wearer difficulties in performing mail handling duties.

In addition, various methods have been proposed for neutralizing anthrax spores contained within mail pieces. These include irradiation with electron beams, gamma rays, X-rays, and ultraviolet (UV) light. Unfortunately, these irradiation techniques may require direct and prolonged exposure to anthrax spores to effectively neutralize them. As such, issues such as costs, personnel safety, damage to mail and mail contents, and mail handling efficiency may limit widespread application of these irradiation techniques.

Methods for heating biological materials for various reasons with single frequency microwave energy are known. For example, U.S. Pat. No. 4,250,139 to Luck et al. discloses a method of exposing dried protein to a lethal dose of single frequency microwave radiation for a time sufficient to provide a desired degree of decontamination. U.S. Pat. No. 5,073,167 to Carr et al. discloses a method of uniformly heating liquid blood and other intravenous fluids using single frequency microwave energy. The use of single frequency microwaves to inactivate spores and bacteria is described by Jeng et al. in *Mechanism of Microwave Sterilization in the Dry State*, Applied and Environmental Microbiology, September, 1987 53: 2133–2137, and by Latimer et al. in *Microwave Oven Irradiation as a Method for Bacterial Decontamination in a Clinical Microbiology Laboratory*, Journal of Clinical Microbiology, October, 1977 6:340–342.

Unfortunately, it can be difficult to achieve uniform distribution of microwave energy within a microwave furnace using single frequency microwave radiation. Hot spots may develop within a microwave furnace cavity which can damage an article being processed. In addition, repeatability of treatment time and results may not be achievable using single frequency microwave radiation without positioning an article in the same position and orientation as a previous article within a microwave furnace cavity.

Single frequency microwave radiation may also cause conductive elements to arc and spark. As such, conductive articles within envelopes and packages, such staples, paper clips, and the like, may arc when exposed to microwave energy, which may damage envelopes and packages and their contents.

U.S. Pat. No. 6,268,200 to Tucker et al., describes attenuating viruses contained within a lyophilized biotherapeutic sealed within a microwave permeable container without harming the biotherapeutic and without exposing the biotherapeutic to additional viruses, by subjecting the container and biotherapeutic therewithin to variable frequency microwave energy.

SUMMARY OF THE INVENTION

In view of the above discussion, systems and methods for neutralizing pathogen-contaminated mail pieces are provided wherein mail pieces are swept with variable frequency microwaves. According to embodiments of the present invention, mail pieces are initially screened to identify any suspicious characteristics or indications of potentially harmful contents (e.g., explosives, biological agents, chemicals, etc.). If a mail piece is determined to have suspicious characteristics, the mail piece is removed from further mail processing/handling and intensive screening procedures can be performed. The remaining mail pieces are then swept with variable frequency microwaves (i.e., at least one range of-microwave frequencies) that are selected to neutralize any pathogen(s) contained within each mail piece without harming the mail piece or the contents thereof. Preferably, each mail piece is swept with one or more ranges of microwave frequencies.

According to embodiments of the present invention, the temperature of each mail piece may be monitored during microwave processing. A rise in temperature of a mail piece beyond a threshold temperature may be an indication that a mail piece contains some type of potentially harmful material (e.g., explosives, biological agents, chemicals, etc.). If a mail piece is determined to have a rise in temperature above a threshold temperature, the mail piece is removed from further mail processing and intensive screening procedures can be performed.

According to embodiments of the present invention, mail pieces can be irradiated via additional forms of radiation to neutralize any pathogenic material on outside surfaces thereof.

Embodiments of the present invention are advantageous because many types of pathogens, whether known or unknown, can be quickly neutralized. Embodiments of the present invention are particularly suited for neutralizing mail pieces contaminated with dangerous, robust bacterial and viral species including, but not limited to, anthrax spores, smallpox, protein based toxins such as *botulinum* toxin, *yersinia pestis* (plague), *francisella tularensis* (tularemia), filoviruses, and arenaviruses. Variable frequency microwaves can penetrate into mail pieces easily and couple with bacterial spores and other pathogens contained therewithin. Moreover, variable frequency microwaves do not cause mail pieces or their contents to overheat, and do not cause conductive articles (i.e., electronic components, paper clips, staples, etc.) within mail pieces to arc which can cause damage.

Furthermore, the present invention is particularly suitable for large-scale mail processing and handling. Large numbers of mail pieces can be simultaneously subjected to microwave energy according to the present invention. Moreover, embodiments of the present invention may be combined easily and inexpensively with conventional mail processing and handling systems of postal services and businesses.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As used herein, "mail" or "mail piece" includes an item (envelope, parcel, package, etc.) entrusted with a postal service, private delivery organization, or individual for transport to a designated destination (e.g., location, person, etc.).

The term "conveyor" is intended to include any type of system for conveying mail pieces. Embodiments of the present invention are not limited to a particular type of conveyor (e.g., single, belt-driven conveyors). Conveyors according to embodiments of the present invention may utilize various types of drives and various types of conveying means (e.g., conveying belts, conveying platforms, etc.).

Systems and methods for processing mail according to embodiments of the present invention may occur in various stages of mail handling and delivery, and in various locations (e.g., private mail carrier, public mail carrier, parcel carrier, private business, government office, public facility, etc.). In mail preparation, a mailer prepares a mail piece or a series of mail pieces for delivery to a recipient by a carrier service such as the United States Postal Service or other postal service or a private carrier delivery service. The carrier services, upon receiving or accepting a mail piece or a series of mail pieces from a mailer, processes the mail piece to prepare it for physical delivery to the recipient. Part of the carrier service processing includes reading the addresses on the mail pieces, sorting the mail pieces for delivery and determining that carrier service charges have been paid by the mailer. Embodiments of the present invention described below are implemented in a postal handling facility prior to delivery to a destination by a carrier. However, embodiments of the present invention can be implemented in various locations and facilities, and by various government entities, business entities, private individuals, etc. Moreover, embodiments of the present invention can be implemented with all types of automated, as well as manual, mail handling devices and systems. Exemplary mail handling and processing systems are available from Pitney Bowes (Stamford, Conn.) and Bell & Howell Mail and Messaging Technologies (Durham, N.C.).

Figure 1:
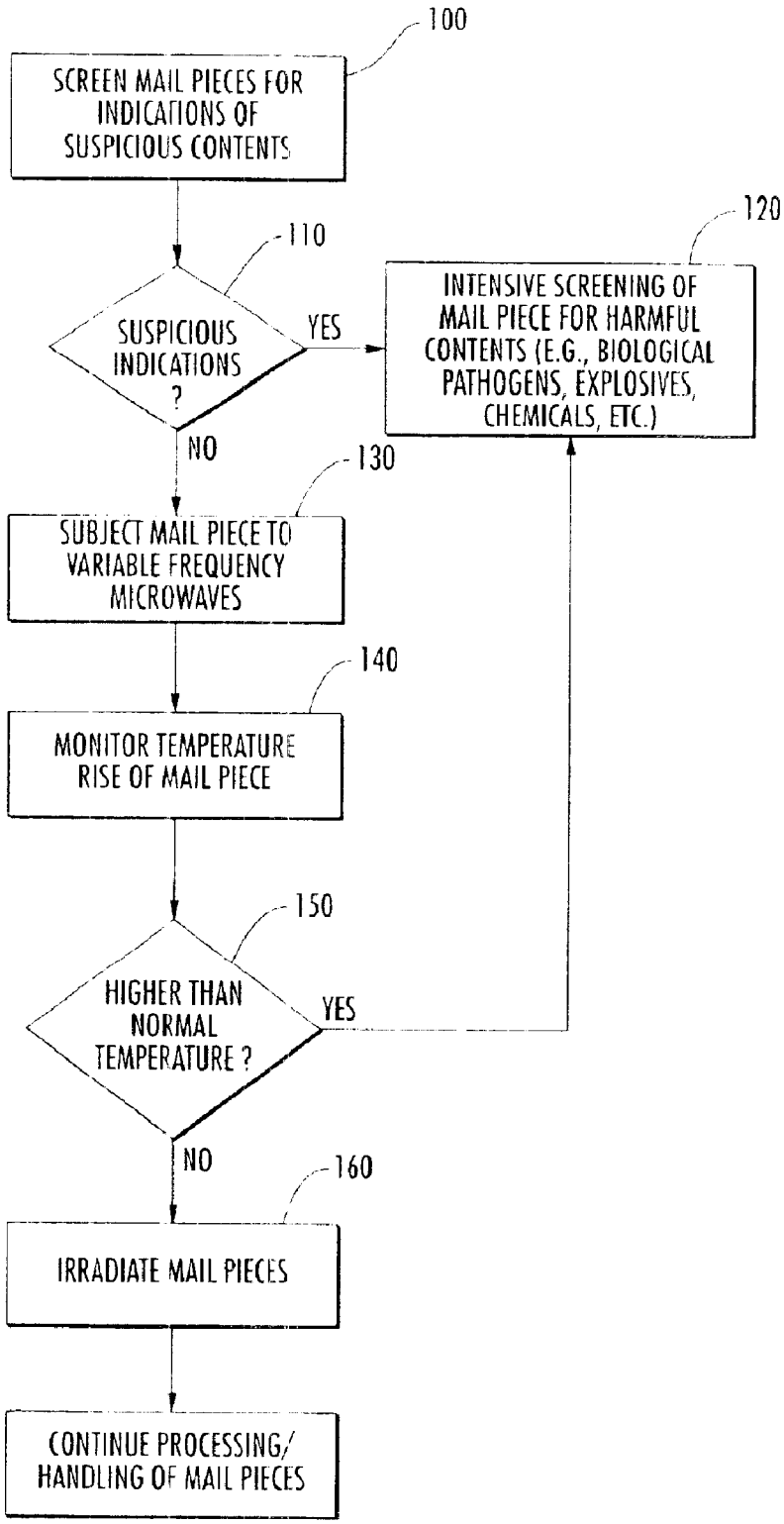
FIG. 1 illustrates systems and methods for neutralizing pathogen contaminated mail pieces, according to embodiments of the present invention.

Referring now to FIG. 1, systems and methods for processing mail according to embodiments of the present invention are illustrated. Mail pieces are initially screened (manually and/or automatically via conventional screening devices) to identify suspicious characteristics or indications of potentially harmful contents (e.g., explosives, pathogens, chemicals, etc.) (Block 100). If a mail piece is determined to have suspicious characteristics (Block 110), the mail piece is removed from further mail processing and intensive screening procedures (Block 120) can be performed (manually and/or automatically via conventional screening devices). The remaining mail pieces are then swept with variable frequency microwaves (i.e., at least one range of microwave frequencies) that are selected to neutralize any pathogen(s) contained within each mail piece without harming the mail piece or the contents thereof (Block 130). According to embodiments of the present invention, the temperature of each mail piece may be monitored (Block 140) during microwave processing. A rise in temperature of a mail piece beyond a threshold temperature may be an indication that a mail piece contains some type of potentially harmful material (e.g., explosives, pathogens, chemicals, etc.) If a mail piece is determined to have a rise in temperature above a threshold temperature (Block 150), the mail piece is removed from further mail processing and intensive screening procedures (Block 120) can be performed. After being swept with variable frequency microwaves, a mail piece can be irradiated via some form of radiation to neutralize any pathogenic material on outside surfaces thereof (Block 160). Mail pieces are then conveyed to a mail processing system and/or handled in some manner. The steps illustrated in FIG. 1 will be discussed below in detail.

As used herein, the term "pathogen" is intended to include bacteria, viruses, biological agents, disease-producing microorganisms, toxic biological products, and organic biocides that can cause death or injury to humans, animals, and/or plants.

Screen for Suspicious Characteristics

Mail pieces are initially screened to identify any suspicious characteristics or indications of potentially harmful contents (e.g., explosives, pathogens, chemicals, etc.) (Block 100). For example, mail pieces may be analyzed via X-ray irradiation to identify suspicious contents. X-ray scanning technology, such as that implemented by airport security, is well known to those skilled in the art, and need not be described further herein. Other types of scanning/detection technologies/methods may be utilized as well, such as sniffing dogs, etc. A list of possible indications of suspicious contents is provided in Table 1 below.

TABLE 1

| |
|---|
| Powdery substance on outside of mail piece. |
| Excessive postage, handwritten or poorly typed address, incorrect titles or titles with no name, or misspellings of common words. |
| Mail piece has unusual weight, given its size, or is lopsided or oddly shaped. |
| Mail piece has an unusual amount of tape. |
| Mail piece has strange odors or stains. |

Sweeping Mail Pieces With Variable Frequency Microwaves

Figure 2:
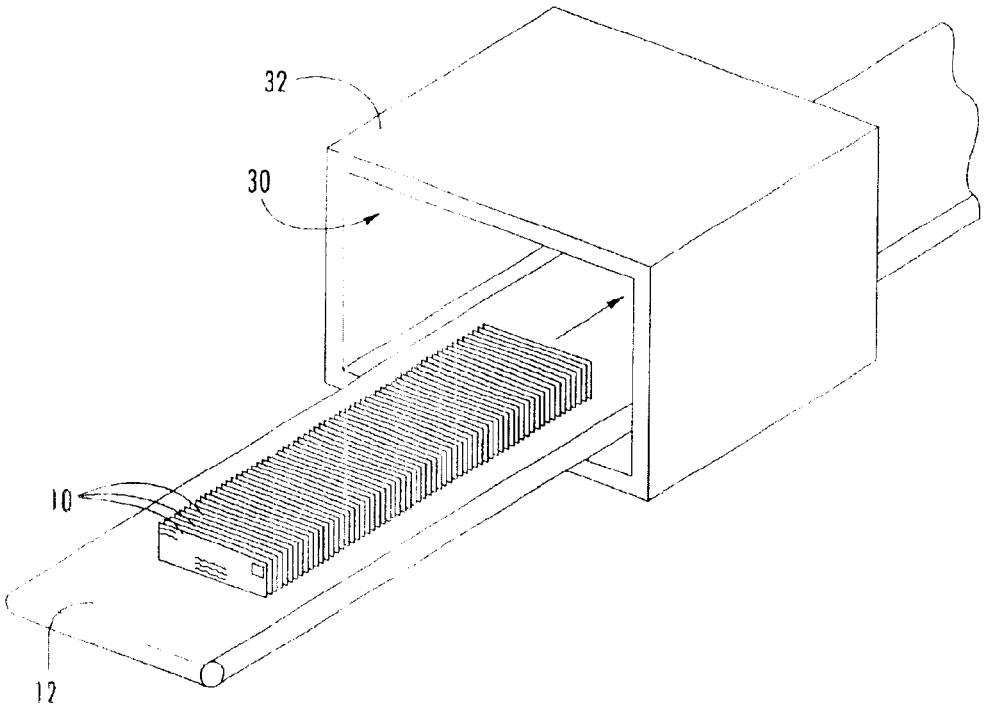
FIG. 2 is a perspective view of a pathogen neutralizing system according to embodiments of the present invention wherein a conveyor system is configured to convey mail pieces into a cavity of a variable frequency microwave furnace.

Mail pieces not deemed initially to be suspicious are swept with variable frequency microwaves that are selected to neutralize any pathogen(s) contained within each mail piece without harming the mail piece or the contents thereof (Block 130). Referring to FIG. 2, mail pieces 10 are conveyed via a conveyor 12 into a cavity 30 of a variable frequency microwave furnace 32 in order to be subjected to variable frequency microwave energy. Variable frequency microwave energy, or a combination of single and variable frequency microwave energy, may be utilized in accordance with the present invention. Preferably, microwave energy is applied by sweeping the mail pieces 10 with at least one range of microwave frequencies to neutralize any pathogens contained therewithin. The range or ranges of microwaves are specifically selected not to harm the mail pieces or the contents thereof.

An exemplary microwave furnace for carrying out the present invention is described in U.S. Pat. No. 5,321,222, to Bible et al., the disclosure of which is incorporated herein by reference in its entirety. Particularly preferred microwave furnaces for carrying out the present invention are a MicroCure® 2100 batch furnace, a MicroCure® 5100 in-line furnace, and a VariWave™ 1500 table top furnace, all manufactured by Lambda Technologies, Morrisville, N.C. In general, a microwave furnace for carrying out the present invention typically includes a microwave signal generator or microwave voltage-controlled oscillator for generating a low-power (i.e., between about 0.015 and 0.15 millivolts) microwave signal for input to the microwave furnace. A first amplifier may be provided to amplify the magnitude of the signal output from the microwave signal generator or the microwave voltage-controlled oscillator. A second amplifier may be provided for processing the signal output by the first amplifier.

A power supply may be provided for operation of the second amplifier. A directional coupler may be provided for detecting the direction of a signal and further directing the signal depending on the detected direction. Preferably a high-power broadband amplifier, such as, but not limited to, a traveling wave tube (TWT), tunable magnetron, tunable klystron, tunable twystron, and a tunable gyrotron, is used to sweep a range of frequencies of up to an octave in bandwidth and spanning a spectrum of from about 300 MHz to about 300 GHz. A range of microwave frequencies for neutralizing pathogens, in accordance with the present invention, may include virtually any number of frequencies, and is not limited in size.

Use of variable frequency microwave processing, as disclosed herein, enhances uniform processing from one mail piece to the next because placement of each mail piece within a microwave furnace cavity, as well as size and shape of each mail piece, is not critical. By contrast, with single frequency microwave processing, each mail piece may need to be oriented the same way within the furnace cavity to achieve identical and repeatable pathogen-neutralizing processing time and quality. Moreover, with single frequency microwave processing, mail pieces having different shapes and sizes may need to be oriented in a different position within the furnace cavity to achieve identical and repeatable pathogen-neutralizing processing time and quality. This is because single frequency microwave processing creates hot spots within a cavity that may overheat particular areas without heating other areas.

The practical range of frequencies within the electromagnetic spectrum from which microwave frequencies may be chosen is generally about 0.90 GHz to 90 GHz. Every mail piece typically has at least one range of microwave frequencies that is optimum for neutralizing pathogens contained therewithin without damaging the mail piece or the contents thereof. Furthermore, the use of variable frequency microwave energy allows mail pieces containing conductive material (e.g., staples, clips, circuit boards, electronic components, computer usable media, etc.) to be subjected to microwave energy without being damaged from arcing or heat as likely would be the case in the presence of only single frequency microwave energy. Each range of microwave frequencies preferably has a central frequency that is optimum for neutralizing a specific pathogen (e.g., anthrax spores, smallpox virus, etc.). The central frequency of each range is bounded on one end by a specific frequency and bounded on an opposite end by a different specific frequency.

Damage from arcing can occur when microwave energy is applied to conductive materials. However, arcing typically occurs only within certain ranges of microwave frequencies. Other ranges of microwave frequencies typically exist wherein arcing does not occur. By selecting one or more ranges of damage-free frequencies, pathogen neutralization can be performed on mail pieces using microwave energy without concern for damage from arcing, even where mail pieces contain conductive materials. Furthermore, a sweeping rate in a particular range of frequencies may also be selected to avoid damage to a mail piece and to contents thereof.

Each range of microwave frequencies preferably has a central frequency that is selected to rapidly perform pathogen neutralization. As will be described below, this means that the selected frequency offers the best match and is likely to be the frequency at which the nucleic acid of a pathogen or some component (or components) of a pathogen, in whole or in part, is at or near maximum absorption of microwave energy (microwave coupling). Microwave energy couples at the molecular level with the material to which it is applied producing volumetric electromagnetic and thermal energy distribution within the material.

The term "coupling" means the process by which energy is provided as microwave radiation is coupled or otherwise transferred to molecular components in a pathogen including, but not limited to, water, protein components necessary for viral, bacterial or spore function (such as viral capsid or spore small acid soluble proteins, DNA repair enzymes), spore dipicolinic acid, calcium dipicolinate, calcium or other metal ions, viral, bacterial or spore nucleic acids. Energy may be directly transferred to these molecular components by various known mechanisms including, but not limited to, excitation of molecular vibration via generation of harmonic acoustic vibration. Energy may be indirectly transferred to these molecular components by various known mechanisms including, but not limited to, excitation of a molecular component via another molecular component. An example of indirect transfer of energy is the excitation of water associated with a nucleic acid, protein, or both, via chemical bonds including, but not limited to, hydrogen bonds. Water associated with a nucleic acid, protein, or both, then transfers energy to the protein, nucleic acid, or both via conductive heat transfer mechanisms.

When microwave energy is optimally tuned for neutralizing a pathogen at a central frequency within a range of frequencies, the neutralization is very efficient as compared with conventional convection heat ovens and can be preferential to a pathogen over other molecular structures (i.e., the pathogen can be neutralized without affecting other molecular structures). The extent to which a given pathogen absorbs microwave energy is determined by the applied microwave frequency, and the electric field distribution within the material.

Often there are multiple ranges of frequencies within which pathogen neutralization may occur without causing damage to a mail piece and contents thereof. For example, a pathogen may be neutralized without causing damage between 3.50 GHz and 6.0 GHz, and may also be neutralized without causing damage between 7.0 GHz and 10.0 GHz. The availability of additional ranges provides additional flexibility for achieving rapid, uniform, yet damage-free pathogen neutralization in mail pieces. The availability of alternative ranges permits a pathogen to be neutralized with microwave energy without having to resort to other neutralization methods (although other methods of neutralization may be used in combination with embodiments of the present invention). The availability of multiple ranges of frequencies also permits "hopping" between two or more ranges during microwave processing to obtain optimum attenuation. For example, optimum attenuation of a particular pathogen may be obtained by sweeping with microwave frequencies between 3.50 GHz and 6.0 GHz for a period of time and then sweeping, for a period of time, between 7.0 GHz and 10.0 GHz. Hopping may also be advantageous for neutralizing multiple pathogens at the same time. For example, one range may be optimum for neutralizing one pathogen and another range may be optimum for neutralizing another pathogen.

Preferably, frequency sweeping is performed using frequencies from within at least one range of frequencies, as described above. Frequency sweeping facilitates uniform pathogen neutralization because many cavity modes can be excited. Frequency sweeping may be accomplished by launching the different frequencies within a range either simultaneously, or sequentially. For example, assume a range of frequencies is 2.60 GHz to 7.0 GHz. Frequency sweeping may involve continuously and/or selectively launching frequencies within this range in any desirable increments, such as 2.6001 GHz, 2.6002 GHz, 2.6003 GHz . . . 3.30 GHz, etc. Virtually any incremental launching pattern may be used without departing from the spirit and intent of the present invention.

The rate at which the different frequencies are launched is referred to as the sweep rate. This rate may be any value, including, but not limited to, milliseconds, seconds, minutes, etc. Preferably, a sweep rate is as rapid as practical for a particular application. In addition, a sweep rate may be selected so that an optimum number of modes are generated within a microwave furnace cavity. Sweep rate may also be selected based on the pathogen or pathogens to be neutralized.

The uniformity in pathogen neutralization afforded by frequency sweeping provides flexibility in how mail pieces are oriented within a microwave furnace, and permits a plurality of mail pieces, including mail pieces of different sizes and shapes, to be processed at the same time without concern for orientation and positioning. Maintaining each mail piece in precisely the same orientation is not required to achieve complete pathogen neutralization. Furthermore, the variable frequency sweeping method of pathogen neutralization, according to the present invention, can be applied in both single mode and multi-mode microwave cavities.

Preferably, a variable frequency microwave furnace for pathogen neutralization, according to the present invention, is under computer control. Under computer control, a microwave furnace may be tuned to a particular frequency, preferably an optimum incident frequency for a particular pathogen, and then may be programmed to sweep around this central frequency to generate a plurality of modes and rapidly move them around the cavity to provide a uniform energy distribution. In addition, an optimum coupling frequency may change during the processing of a pathogen. Accordingly, it is preferred that a central frequency be adjustable, preferably under computer control, to compensate automatically for such changes.

According to embodiments of the present invention, each mail piece 10 may be heated to a predetermined temperature prior to sweeping with variable frequency microwaves. Typically, this temperature will be in a range of temperatures between about 60° C. and about 190° C. Such a predetermined temperature is selected so as not to damage a mail piece or the contents thereof.

Figure 3A:
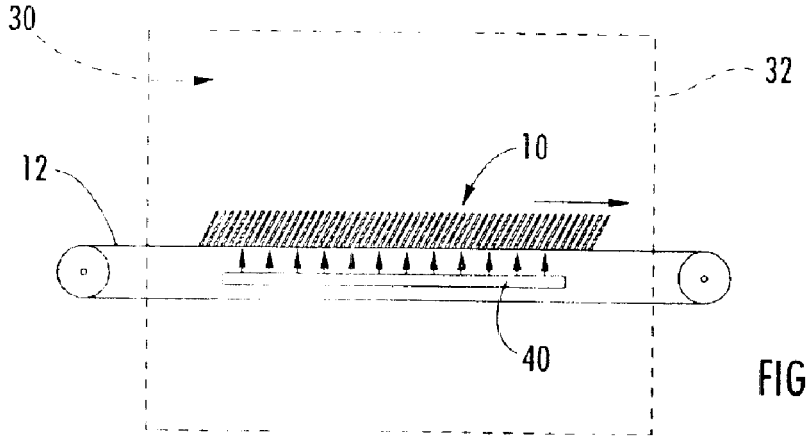
FIG. 3A is a side view of a pathogen neutralizing system according to embodiments of the present invention wherein one or more resistance heating elements are positioned beneath the conveyor and are configured to heat mail pieces within a cavity of a variable frequency microwave furnace to a predetermined temperature.
Figure 3B:
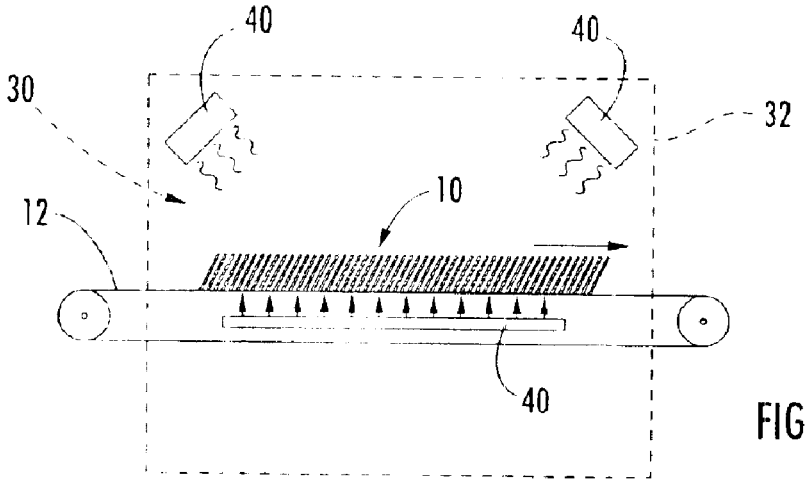
FIG. 3B is a side view of a pathogen neutralizing system according to embodiments of the present invention wherein additional resistance heating elements are positioned above the conveyor and are configured to heat the mail pieces within a cavity of a variable frequency microwave furnace to a predetermined temperature.

As illustrated in FIG. 3A, one or more resistance heating elements 40 may be positioned beneath the conveyor 12 that are configured to heat the mail pieces 10 within the cavity 30 to a predetermined temperature. The belt portion of the conveyor 12 is preferably formed from material that facilitates heat transfer therethrough, such as rubber and other similar materials. According to embodiments of the present invention illustrated in FIG. 3B, additional resistance heating elements 40 may be positioned above the conveyor 12 that are configured to heat the mail pieces 10 within the cavity 30 to a predetermined temperature.

Figure 3C:
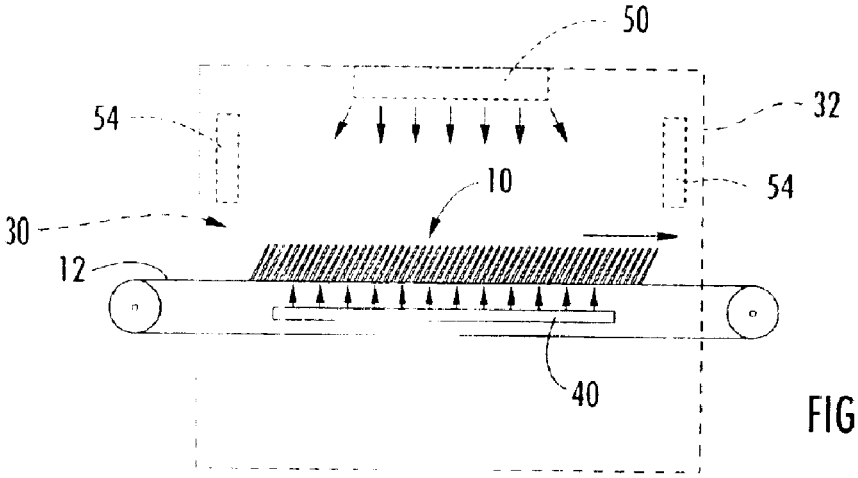
FIG. 3C is a side view of a pathogen neutralizing system according to embodiments of the present invention wherein hot air is provided within a cavity of a variable frequency microwave furnace to heat mail pieces to a predetermined temperature, and wherein microwave susceptor material is positioned within the cavity.

According to embodiments of the present invention illustrated in FIG. 3C, hot air can be provided within the cavity 30 via hot air supply 50 to heat the mail pieces 10 to a predetermined temperature. In addition, microwave susceptor material 54 may be positioned within the cavity 30 in various locations including beneath the conveyor 12. As known to those skilled in the art, microwave susceptor materials are configured to absorb microwave energy and radiate this energy as heat. Exemplary microwave susceptor materials that may be used in accordance with embodiments of the present invention include, but are not limited to, doped silicon, and metalized polyethylene terephthalate (PET) film laminated to paperboard or other semi-conductive materials.

Figure 4:
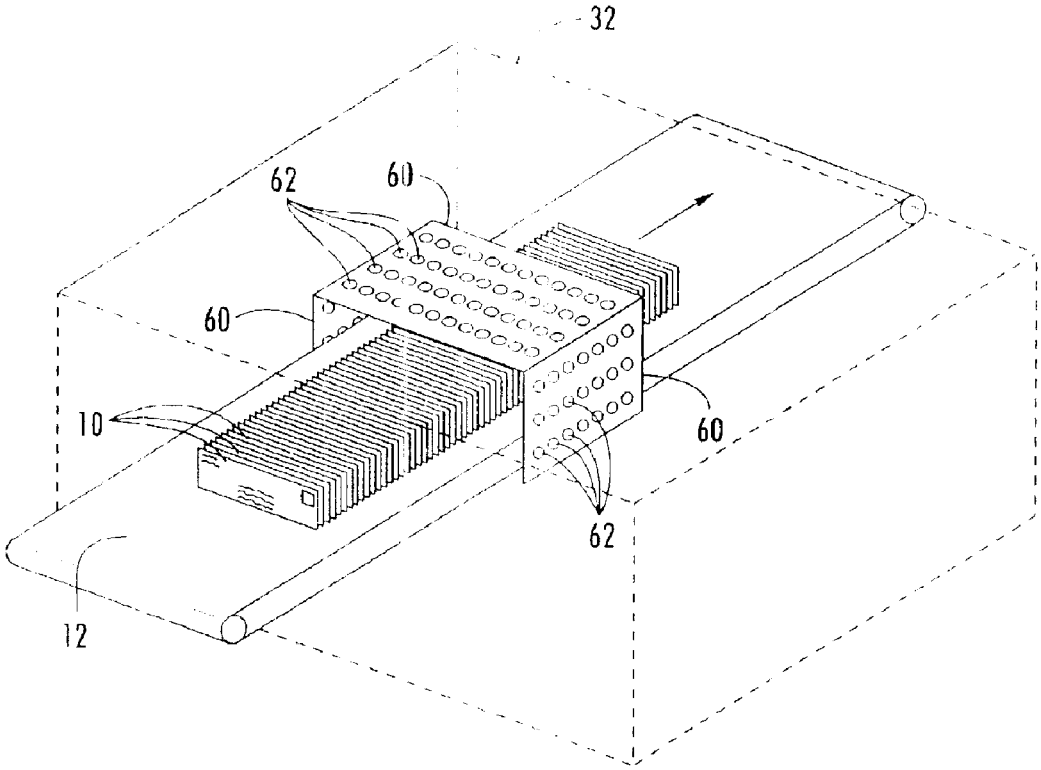
FIGS. 4–5 are perspective views of a pathogen neutralizing system according to embodiments of the present invention wherein a conveyor system is configured to convey mail pieces into a cavity of a variable frequency microwave furnace and adjacent to one or more microwave diffuser plates.
Figure 5:
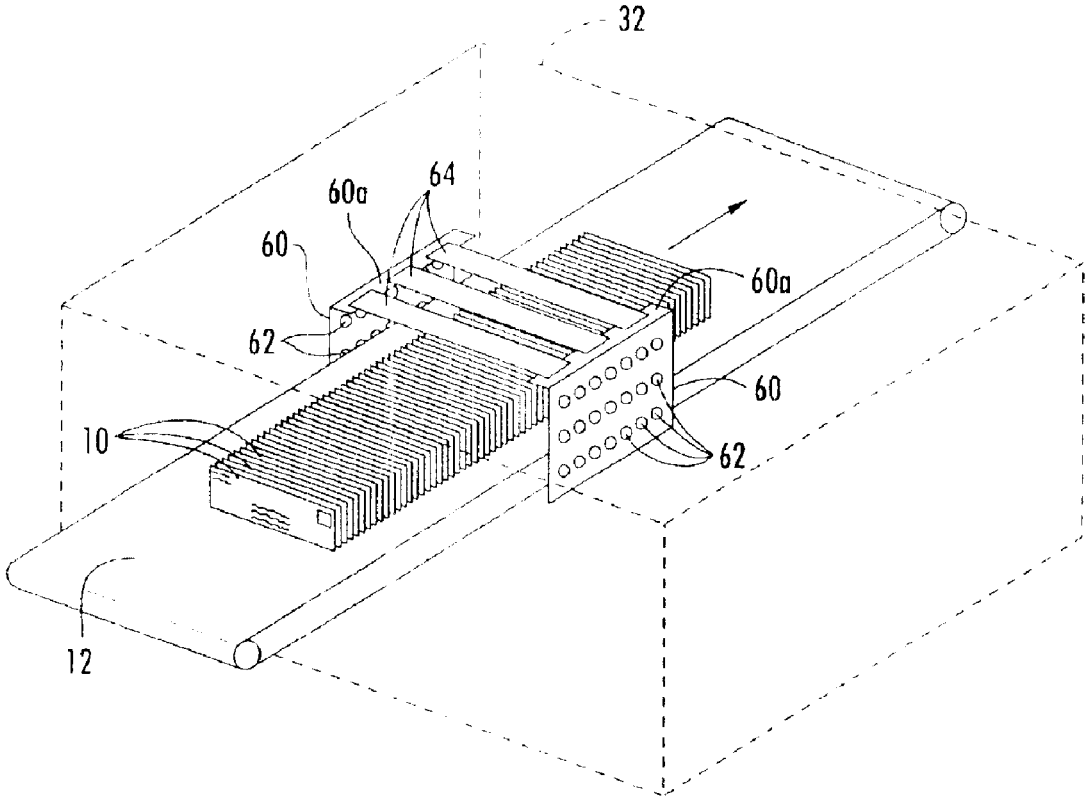

FIGS. 4–5 demonstrate the use of diffuser plates and susceptors to assist pathogen neutralization, according to embodiments of the present invention. Diffuser plates enhance microwave field uniformity. Susceptors heat in the presence of microwave fields and can be used to mitigate microwave field intensification. Diffusers can be constructed from microwave reflective materials such as metals or microwave absorbing materials such as doped silicon or carbon fiber doped composites. FIGS. 4–5 demonstrate the use of diffuser plates with an array of apertures and susceptor strips to enhance the variable frequency microwave neutralization of pathogens that might be present in mail pieces.

According to embodiments of the present invention illustrated in FIG. 4, sweeping each mail piece 10 with variable frequency microwaves may include passing each mail piece 10 adjacent to one or more microwave diffuser plates 60 positioned between the mail piece and a variable frequency microwave source. In the illustrated embodiment, each diffuser plate 60 includes an array of apertures 62 formed therein that are configured to facilitate even distribution of microwave energy within the microwave cavity 30.

According to embodiments of the present invention illustrated in FIG. 5, sweeping each mail piece 10 with variable frequency microwaves may include passing each mail piece 10 between a pair of generally parallel, spaced-apart diffuser plates 60. In the illustrated embodiment, each diffuser plate 60 includes an array of apertures 62 formed therein that are configured to facilitate even distribution of microwave energy within the microwave cavity 30. In addition, strips 64 of microwave susceptor material (e.g., doped silicon, carbon fiber doped composites, etc.) extend between upper edge portions 60 a of the diffuser plates 60, as illustrated. The strips of microwave susceptor material 64 are configured to heat the mail pieces and, at the same time, mitigate microwave field intensification.

The diffuser plates 60 in the illustrated embodiments of FIGS. 4 and 5 may be formed from various materials including, but not limited to, aluminum, steel, copper, brass, stainless steel, bronze, semi-conducting doped silicon, composites such as epoxy resin and glass fiber composites, carbon fiber doped composites, and microwave absorbing ceramics such as aluminum silicate and silicon carbide. Apertures 62 in diffuser plates 60 according to embodiments of the present invention may have various shapes and sizes. Moreover, various aperture array patterns may be utilized.

Neutralizing Pathogens on Outer Surfaces of Mail Pieces

Figure 6:
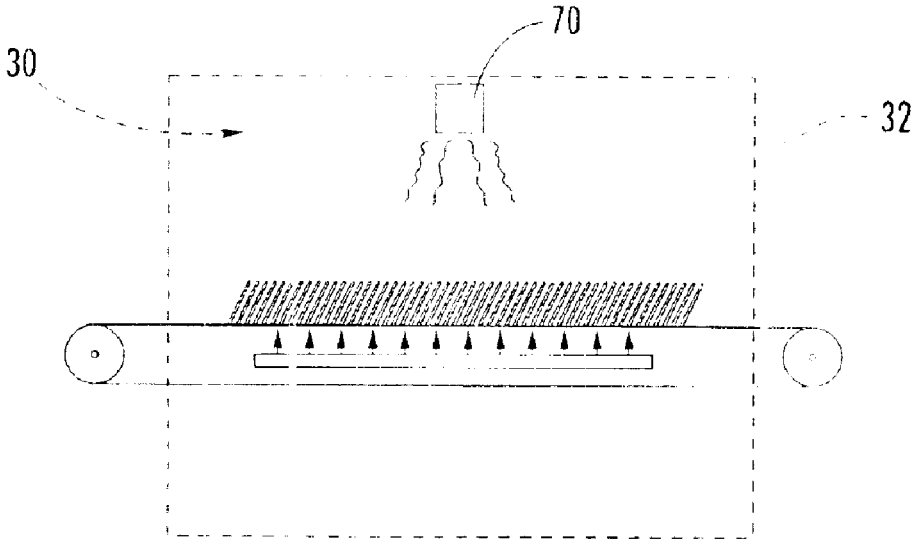
FIG. 6 is a side view of a pathogen neutralizing system according to embodiments of the present invention wherein a radiation source is configured to irradiate each mail piece to neutralize pathogens on outside surfaces thereof.

According to embodiments of the present invention illustrated in FIG. 6, a radiation source 70 may be provided that is configured to irradiate each mail piece (e.g., via UV light, plasma generator) to neutralize pathogens on the outside surfaces of each mail piece In the illustrated embodiment, the radiation source 70 is positioned within the microwave cavity 30. Mail pieces may be irradiated before, during, and/or after being swept with variable frequency microwaves within the cavity 30 according to embodiments of the present invention. In addition, radiation sources according to embodiments of the present invention may be positioned outside of the cavity 30 and mail pieces may be irradiated either before or after being swept with variable frequency microwaves. Various types of radiation may be utilized to neutralize pathogens on the outside surfaces of mail pieces including, but not limited to, UV light, gamma rays, X-rays, electron beams, plasma via plasma generators.

Monitoring Temperature of Mail Pieces

Figure 7:
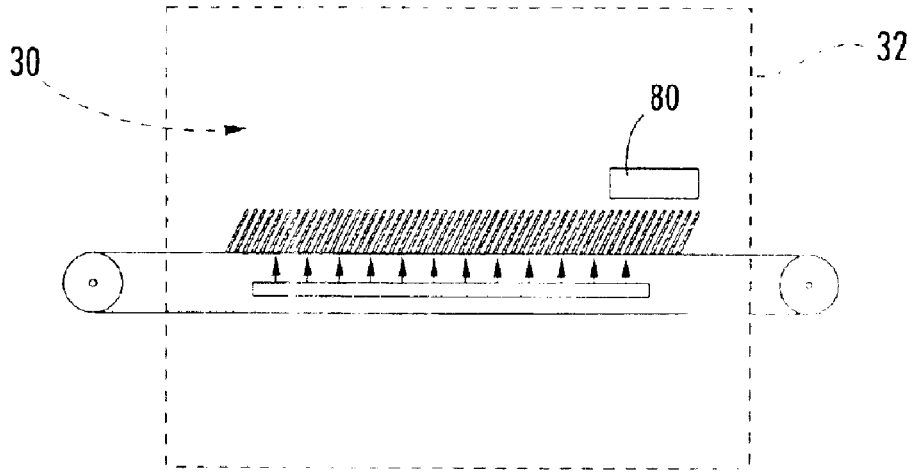
FIG. 7 is a side view of a pathogen neutralizing system according to embodiments of the present invention wherein a temperature sensor is configured to monitor temperature changes of mail pieces after being swept with variable frequency microwaves.

According to embodiments of the present invention illustrated in FIG. 7, the temperature of each mail piece 10 is monitored via a temperature sensor 80 to detect any unusual rises in temperature after being swept with variable frequency microwaves. Temperature increases above a threshold level may be indicative of potentially harmful contents, such as explosives, chemicals, etc. Various types of temperature sensors may be utilized including sensors that physically contact each mail piece and sensors that do not require contact. Exemplary temperature sensors include, but are not limited to, infrared (IR) sensors, optical sensors, and thermocouples. In addition, temperature sensors according to embodiments of the present invention may be positioned outside of the microwave cavity 30.

Theories of Pathogen Neutralization Via Microwaves

Figure 8A:
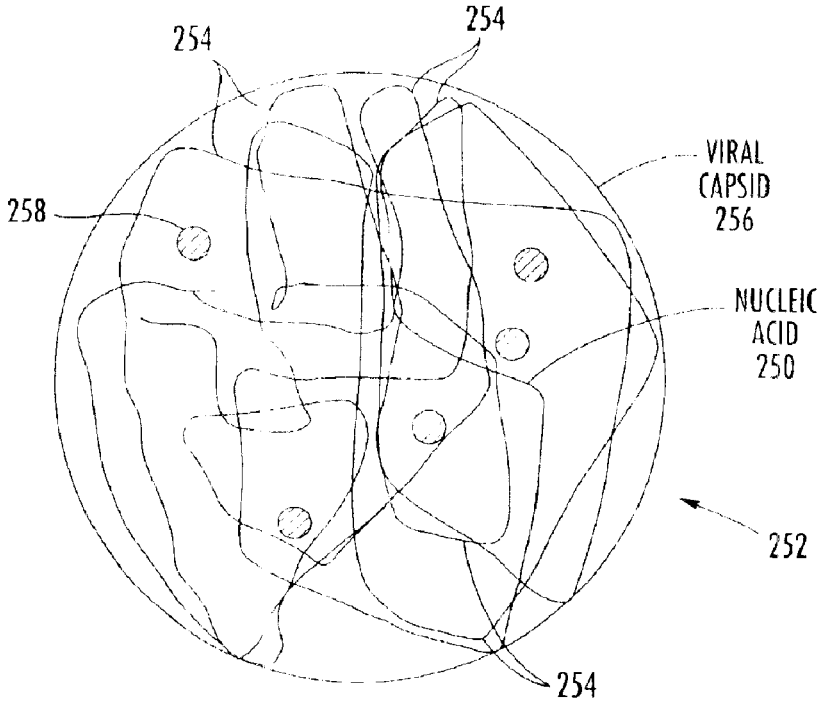
FIG. 8A schematically illustrates a viral pathogen including a nucleic acid core, capsid envelope and water molecules.

Although not fully understood, Applicants believe that there are at least three theories that explain how microwave energy neutralizes viral pathogens according to embodiments of the present invention. Referring to FIG. 8A, each of these theories centers around the presumption that a nucleic acid core 250 of a pathogen is disrupted or broken in some manner, or that the association of nucleic acid and capsid and/or relation between capsid components is disrupted. As is known to those skilled in the art of nucleic acids, nucleic acids, such as ribonucleic acid (RNA) and deoxyribonucleic acid (DNA) are large, acidic, chainlike molecules having a helix structure. The helix structure is composed of a strand 254 of material such as purine and pyrimidine joined together by hydrogen bonds.

According to one theory, microwave energy causes vibrations within the helix of the nucleic acid that can cause a helix strand 254 to break apart. According to another theory, the capsid 256 enclosing the nucleic acid core 250 of a pathogen 252 is modified by microwave energy such that the pathogen 252 itself can lose its ability to infect living cells. For example, microwave energy can affect the envelope surrounding a pathogen such that the pathogen cannot attach itself to another cell. Alternatively, microwave energy may disrupt an association of nucleic acid and capsid necessary for infectivity.

According to a third theory, there may be water molecules 258 in close association with the nucleic acid core 250 of a pathogen 252 inside the capsid 256. Water molecules may also be in association with capsomers, and there is also mediating association of nucleic acid and capsid. It is possible that selective coupling with water molecules 258 inside the pathogen capsid 256 via microwave energy can result in neutralization of the pathogen. Water molecules are believed to provide stability to the nucleic acid and capsids of a pathogen. By coupling with the water molecules, the nucleic acid, the capsid, and the interaction between the nucleic acid and capsid can become unstable rendering the pathogen ineffective. Bacterial pathogens are believed to be neutralized by mechanisms similar or identical to those effective in neutralizing viral pathogens. Bacterial pathogens are far more complex than viruses and contain many proteins which are required for function. Such proteins including but not limited to bacterial enzymes, structural proteins, and components of the bacterial coat are potential targets of microwave irradiation in a manner analogous to that of the viral capsid protein.

Dry heat killing of bacterial spores (e.g., anthrax spores) is mediated, in large part, by DNA damage. DNA repair enzyme systems, level of spore minerals and the presence of proteins termed alpha/beta small acid soluble proteins (SASPs) all play a role in protecting the spore from dry heat. Spore protection is mediated by stabilization of DNA structure to heat denaturation (by the SASPs and possibly by mineral content) and repair of damage during spore germination (by DNA repair enzymes).

The targets for dry heat killing of spores are likely to be the protective proteins and presumably, the spore DNA. The resistance of spores to UV irradiation appears to be quite similar to that involved in the resistance to dry heat. The mechanisms responsible for gamma and X-ray resistance of spores are poorly characterized but are likely to involve the low level of free water in spores inhibiting the generation of water derived DNA reactive free radicals. SASPs do not play a role in the gamma ray resistance of spores.

Dry heat sterilization is often done at elevated temperatures for prolonged periods of time. Commonly suggested values for use in the clinical laboratory are 160–170° C. for two to four hours. The common presumption that microwaves are not a particularly effective method of bacterial sterilization is incorrect and based on the use of "home-type" microwave ovens used to sterilize volumes of contaminated liquids.

Figure 8B:
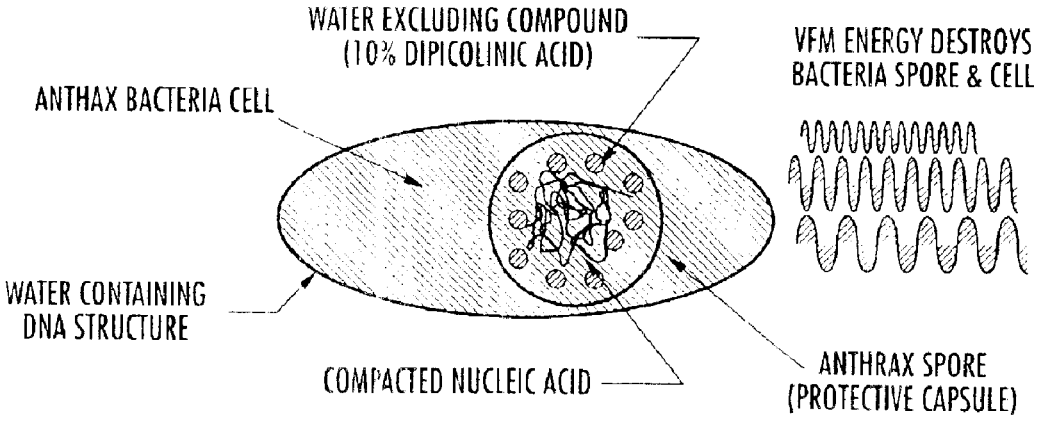
FIG. 8B schematically illustrates a bacterial spore pathogen.

FIG. 8B summarizes hypothetical mechanisms by which microwave energy may interact with spore components leading to spore inactivation. In FIG. 8B, a daughter spore is shown within a parent anthrax cell. In contrast to the parent cell the spore is protected from the environment by having compacted DNA (mediated by SASPs as described above (not shown)), a protective specialized capsule (cell wall) and high levels of dipicolinic acid (which may serve to bind or exclude free water). Microwave energy may mediate killing by interaction with free water (in the parent cell) and transfer of this energy to critical cellular components such as DNA or proteins. In the spore (with little or no free water) microwave energy may interact directly with nucleic acids or proteins or via water bound to components such as dipicolinic acid and metal ions

Experimental Results #1

Preliminary studies indicate that microwave killing of bacterial spores using variable frequency microwaves (VFM) is effective and rapid. Estimates of the kinetics of spore killing ($D_t$ values) are significantly more rapid than published D values measured in hot air ovens. Preliminary studies detailed below demonstrate that:

(1) Microwave killing of *B. subtilis* spores deposited on paper and contained in simulated mail pieces was rapid. One million ($10^6$) spores could be killed in as little as 60 seconds.

(2) Spore killing could be accomplished without damage to the sample mail piece.

(3) The rapid killing suggests that a mechanism other than thermal heating (as accomplished by hot air ovens) plays a role in microwave mediated spore killing.

Methods: Formal definition of the kinetics of bacterial and spore killing and the measurement of sterilization effects is defined in a variety of international standards including U.S. Pat. No. 24 and ANSI/AAMI/ISO11138. These preliminary tests were not performed under the above defined conditions but are believed to give reasonable, scientifically valid estimates of the utility of variable frequency microwave technology in pathogen neutralization of mail.

Sample Spores: Sample spores were commercially available spore test strips (SGMD/66 dual species spore test strips, SGM Biotech, Bozeman, Mont.) containing $1.5\times10^6$ *B. stearothermophilus* and $2.6\times10^6$ *B. subtilis* spores deposited on filter paper and provided in glassine packages.

VFM Device: A Lambda Technologies MicroCure 2100-700 was operated at a power level of 400 W with a center frequency of 6.425 GHz and 1.15 GHz bandwidth using a 100 millisecond sweep time. Temperature inside the sample mail load was monitored with a Nortech fiber optic probe and regulated through software controlled modulation of applied microwave power. Sample mail external temperature was measured with a Raytek non-contact infrared temperature sensor.

Sample Mail Load: The sample mail load consisted of ten sheets of standard photocopy paper (8.5×11 inch) inserted into a self-sealing envelope (9×12 inch) designed to hold the sheets unfolded. For each test point, two spore strips in glassine packages were inserted in the middle of the test load (between the $5^{th}$ and $6^{th}$ sheets) at the approximate center of the envelope. The Nortech probe was placed immediately adjacent to the test strips and the sensor cable was routed out through the envelope flap. The test mail was placed flat on a support in the VFM chamber. The Raytek sensor was directed toward the upper external surface of the envelope. The Nortech device allowed measurement of the internal mail load temperature proximate to the test spore strips and was used to control the VFM device.

Treatment Plan: The treatment plan was devised to give a rough estimate of time required to sterilize a fixed number of spores at a variety of temperatures. The machine's software controller was programmed to bring the temperature (measured within the mail load) to a predetermined target temperature ("0" time) and then continue to hold temperature for zero, two or four minutes. Hence, at each temperature viability of spores was measured at "0", "2" and "4" minute time points with the total treatment time being recorded. In addition, a control run was allowed to remain in the oven for a total of four minutes with no power applied. Runs were not commenced until the internal oven temperature fell below 70° C. A similar treatment protocol was used with a hot air (convection) oven except that the mail load was not instrumented. No attempt was made to simulate the VFM heating profile.

Sample Evaluation: After treatment, each set of two glassine envelopes was transferred to marked polyethylene sample bags and delivered to the Clinical Microbiology Laboratories of the University of North Carolina Hospital (Chapel Hill, N.C.) within one hour. Culturing was performed by a certified laboratory technician. Strips were removed from the glassine envelopes to two tubes containing 10 ml. of sterile soy casein broth using a sterile technique. One set of tubes was cultured at 37° C. in a warm air incubator to monitor for growth of *B. subtilis*. The second set was cultured at 56° C. in a water bath to check for growth of *B. stearothermophilus*. The *B. subtilis* tubes were read at 24 or 48 hours of incubation. *B. stearothermophilus* was read at 48 hours. Preliminary runs did not demonstrate additional growth with prolonged incubation—rereading at 72 hours did not alter results. Although more formal determination of kill kinetics would use prolonged incubation times, it is believed that these results are a reasonable estimate of kill times. Growth was defined as the presence of any turbidity or precipitate in the tubes visible on gentle agitation. Growth was a clear cut endpoint. Tubes showed either marked turbidity on reading or were clear. The above assay, although sensitive, is not quantitative. Tubes that showed no growth indicated killing of the $10^6$ spores; tubes with growth indicated some number of residual viable spores. Partial killing was not assessed. Data is presented on two independent runs.

TABLE A

Summary of Results of VFM Treatment Run 1

| | Sample Number | | | | | | | | | | | | | | | |
|---|---|---|---|---|---|---|---|---|---|---|---|---|---|---|---|---|
| | 01 | 02 | 03 | 04 | 05 | 06 | 07 | 08 | 09 | 10 | 11 | 12 | 13 | 14 | 15 | 16 |
| Target Temperature (° C.) | N/A | | 150 | | | 160 | | | 170 | | | 180 | | | 190 | |
| Time @ Target Temperature (min)[1] | 4 | 0 | 2 | 4 | 0 | 2 | 4 | 0 | 2 | 4 | 0 | 2 | 4 | 0 | 2 | 4 |
| Final Outer Temp. (° C.) | 29 | 137 | 121 | 120 | 127 | 143 | 153 | 141 | 147 | 162 | 151 | 157 | 155 | 178 | 173 | 159 |
| Total Cycle Time (sec) | 240 | 73 | 167 | 286 | 53 | 170 | 288 | 56 | 173 | 294 | 59 | 175 | 301 | 73 | 191 | 313 |
| *B. Stearothermophilus* Growth[2] | + | 0 | 0 | 0 | 0 | 0 | 0 | 0 | 0 | 0 | 0 | 0 | 0 | 0 | 0 | 0 |
| *B. Subtilis* Growth[2] | + | + | + | 0 | + | 0 | 0 | + | 0 | 0 | 0 | 0 | 0 | 0 | 0 | 0 |

TABLE B

Summary of Results of VFM Treatment Run 2

| | Sample Number | | | | | | | | | | | | | | | |
|---|---|---|---|---|---|---|---|---|---|---|---|---|---|---|---|---|
| | 01 | 02 | 03 | 04 | 05 | 06 | 07 | 08 | 09 | 10 | 11 | 12 | 13 | 14 | 15 | 16 |
| Target Temperature (° C.) | N/A | | 120 | | | 130 | | | 140 | | | 150 | | | 160 | |
| Time @ Target Temperature (min)[1] | 4 | 0 | 2 | 4 | 0 | 2 | 4 | 0 | 2 | 4 | 0 | 2 | 4 | 0 | 2 | 4 |
| Final Outer Temp. (° C.) | 23 | 97 | 951 | 93 | 107 | 101 | 101 | 113 | 108 | 112 | 121 | 115 | 116 | 127 | 124 | 130 |
| Total Cycle Time (sec) | 240 | 83 | 168 | 281 | 51 | 173 | 289 | 58 | 181 | 297 | 65 | 184 | 304 | 68 | 189 | 313 |
| *B. Stearo-thermophilus* Growth[2] | + | + | + | + | + | + | 0 | + | 0 | 0 | + | 0 | 0 | 0 | 0 | 0 |
| *B. Subtilis* Growth[2] | + | + | + | + | + | + | + | + | + | + | + | + | 0 | + | 0 | 0 |

Summary of Results of Convection Oven Treatment

| | Sample Number | | | |
|---|---|---|---|---|
| | 17 | 18 | 19 | 20 |
| Oven Set Temperature (° C.) | | | 160 | |
| Time in oven (min)[1] | 2 | 4 | 8 | 16 |
| *B. Stearothermophilus* growth[2] | + | + | 0 | 0 |
| *B. Subtilis* growth[2] | + | + | + | + |

[1]"0" time represents sample removed from oven as soon as target temperature reached, "2" or "4" represents sample held for an additional 2 or 4 minutes at target temperature.
[2]+ represents growth of bacteria as described above, 0 represents no growth.

Spore killing was most rapid at greater than or equal to 180° C. where spore killing was complete by the time the internal sample temperature reached target temperature. For example, one million *B. subtilis* spores could be killed in one minute under the conditions shown in tube sample 11 in Treatment Run 1. At lower target temperatures spore killing was accomplished by holding the spores at the selected temperature for longer times. At 160° C. and 170° C., spores were killed after 2 minutes of treatment. At 150° C. four minutes were required for killing. This data can be used to make a rough estimate of observed $D_t$ values (time to reduce spore count 90% or one $\log_{10}$ at a given temperature). If we make the very conservative assumption that sample 6 was at 160° C. for the entire treatment time of 170 seconds (remembering the sample was simply reaching temperature during the first 50–60 seconds) then we have killed 6 logs of bacteria for a $D_{160}$ of about 30 seconds (170/6=28.3). Published D values for *B. subtilis* in spore strips are about 120 seconds (manufacturer's specification for the lot used in this study). At higher temperatures D values were less than 10 seconds. Hence, it is possible that even 12 log sterilization can be achieved using variable frequency microwaves within two to three minutes of treatment.

Experimental Results #2

Additional studies using a MicroCure 2100-700 variable frequency microwave device (Lambda Technologies) lend support to the utility of VFM technology for inactivating bacterial spores in mail as follows:

1) Microwave killing of *B. subtilis* spores deposited on paper and contained in simulated mail packages was studied using laboratory prepared high spore count strips (about $1\times10^9$ spores per strips). Spore counts were accomplished using standard quantitative procedures (rather than growth/no growth assays).
2) Spore killing was rapid and reproducible. Over $10^9$ *B. subtilis* spores were killed after one minute of treatment at 160° C.
3) Similar studies using laboratory prepared *B. anthracis* (Sterne strain) spore strips (about $1\times10^6$ spores per strip) demonstrated no residual spores after 30 seconds of treatment at 160° C.
4) The additional quantitative studies support a conservative estimate of $D_{160}$ (time to kill one log of spores at 160° C.) as 18 seconds or less. Twelve logs of kill should require no more than 3.6 minutes of VFM time. A similar $D_{160}$ was estimated for *B. anthracis*.

Introduction: Initial studies of VFM technology for use as a method of inactivating bacterial spores in mail suggested that such technology has great potential because VFM killing of *B. subtilis* spores deposited on paper and contained in simulated mail packages was rapid. One million ($10^6$) spores could be killed in as little as 60 seconds under conditions which did not damage the sample mail package. (Experimental Results #1 above.) Additional studies were conducted that extend this previous work. Specifically:

1) All inactivation experiments include an untreated control to establish the ratio from which survival fraction is taken.
2) All experiments use serial dilutions and bacterial colony forming unit counts to establish the number of residual viable spores.
3) The use of *B. stearothermophilus* spores was discontinued because of its dry heat sensitivity; instead, *B. anthracis* (Sterne strain) spores have been substituted therefor.

4) Methods have been developed for preparing high spore count *B. subtilis* test spore strips ($10^9$ spores as compared to the $10^6$ spores per strip used in initial studies) and also *B. anthracis* test spore strips.

Methods:

Sample Spores Strips: Sample spore strips were prepared in-house from ATCC 9372 spore preparations in deionized water (prepared by NAMSA Laboratories) or from *B. anthracis* veterinary live spore vaccine (Colorado Serum Company). *B. anthracis* spores were washed three times in deionized water, dispensed onto S & S 903 specimen collection paper strips (Schleicher & Schuell), air dried and stored in individual glassine envelopes at room temperature all under sterile conditions. *B. subtilis* strips assayed at $1.5\times10^9$ spores per strip (7 determinations with a mean standard deviation of $0.15\times10^9$ per determination). *B. anthracis* strips were prepared in two batches with 1.1 and $0.9\times10^6$ spores per strip (4 determinations per batch with mean standard deviations of 0.4 and $0.9\times10^5$). Scanning Electron Microscopic (SEM) analysis of *B. subtilis* has confirmed the absence of bacteria on sample spore preparations. Vaccine preparations of *B. anthracis* spores are tested by the manufacturer for the absence of vegetative cells. This was confirmed by determining that heat shocking of such preparations did not decrease (but in fact increased) colony counts. *B. anthracis* spore preparations appeared somewhat unstable as a significant decreasing trend in germinant colony yield was noted with time. This was not observed with *B subtilis* spore preparations. Untreated controls were from the same batch and identical in age to experimental spore strips in all experiments.

Sample Evaluation (VFM Aspects): A Lambda Technologies MicroCure 2100-700 was operated at a power level of 400 W with a center frequency of 6.425 GHz and 1.15 GHz bandwidth using a 100 millisecond sweep time. Temperature inside the sample mail load was monitored with a Nortech fiber optic probe and regulated through software controlled modulation of applied microwave power. Sample mail external temperature was measured with a Raytek non-contact infrared temperature sensor. Care was taken to match the temperature response of the Nortech fiberoptic contact probe (used to measure the internal temperature of the mail package and control the VFM) and Raytek non-contact IR emissivity device (used to measure the external temperature of the mail package) by simultaneous measurement of a silicon dummy thermal load. All IR emissivity readings were made off a small target of high temperature (Kapton) tape of a known emissivity of 1.00 fixed to the exterior of the envelope.

Sample Mail Load: The sample mail load consisted of ten sheets of standard photocopy paper (8.5×11 inch) inserted into a self-sealing envelope (9×12 inch) designed to hold the sheets unfolded. For each test point, a single spore strip in a glassine package was inserted in the middle of the test load (between the $5^{th}$ and $6^{th}$ sheets) at the approximate center of the envelope. The Nortech probe was placed immediately adjacent to the test strips and the sensor cable was routed out through the envelope flap. The test mail was placed flat on a support in the VFM chamber. The Raytek sensor was directed toward the tape target on the upper external surface of the envelope.

Treatment Plan: The treatment plan was devised to determine the effect of time and internal mail load temperature on the killing of spores in the VFM device. The machine's software controller was programmed to bring the temperature (measured within the mail load) to a predetermined target temperature ("0" time) and then continue to hold temperature for a predetermined period of time. Typical run settings included a "0" time point (machine just reaches indicated temperature) and "soak" times of 30 seconds to four minutes. A similar treatment protocol was used with a hot air (convection) oven except time periods of five to thirty minutes were used. Timing was started as soon as the sample load was placed in the oven. External temperature was measured with an extended range mercury thermometer positioned in the airflow and internal sample mail temperature was measured as above using a Raytek device. No attempt was made to simulate the VFM heating profile because of the relatively slow thermal recovery profile of the oven. (About ten minutes were required to reach 160° C. after loading the oven.) All experimental runs included a non-VFM (or dry heat) treated control (allowed to remain in the cool VFM chamber for two to four minutes) and a variety of sterility controls on assay components.

Sample Evaluation (Assay Aspects): Treated and control spore preparations were evaluated using quantitative spore counting modeled on USP and ISO methods under sterile conditions. In brief, spore strips were disaggregated in 10 ml sterile deionized water (DW) using a Seward Stomacher 80. Treatment of strips for 2 minutes on high setting produced satisfactory fiber suspensions. *B. subtilis* strips which had been VFM treated for >2 minutes at 160° C. (and for shorter periods at higher temperatures) were occasionally resistant to disaggregation and treated for an additional 2 minutes. In such cases care was taken to culture the undiluted disaggregated material and include suspended fibers so as to count any spores that might bind to insoluble material. Additional studies indicate that the presence of varying amounts of disaggregated paper fiber does not effect the quantitative accuracy of the spore counting procedure. SEM studies indicated that spores did penetrate the strips to the side opposite from which they were applied. The disaggregated strips were heat shocked at 82° C. for ten minutes and immediately chilled on ice. *B. anthracis* has been heat shocked as above but preliminary evidence indicates that 72° C. is optimal and yields about a two-fold increase in colony counts. Heat-shocking insures the absence of bacteria contaminants in spore preparations (which could give erroneously high killing) and yields more uniform germination. Heat shocked spores are generally immediately diluted and cultured but pilot experiments indicate that stock spore suspensions have stable counts for 24–48 hours if stored at 4° C. Spore preparations were assayed for surviving viable spores after serial ten fold dilutions in DW (between $10^1$ (the disaggregated preparation) and $10^8$ final dilution) by preparing triplicate TSA pour plates each using 1 ml of the appropriate dilution. A minimum of two dilutions were assayed for each experimental point. Note that the most concentrated preparation assayed represents 1 ml of a ten ml suspension of disaggregated strip. Hence, the maximum sensitivity of this assay is roughly 10 residual viable spores. Plates with between about 200 to 20 colonies were optimal for counting. *B. subtilis* plates were read at about 30 hours, colonies were marked and re-read at 44–48 hours to prevent overgrowth of larger colonies. *B. anthracis* was read at about 24 hours and again at about 36 hours as the organism is relatively quick growing and spreads on plates.

Calculation of D values: Residual spore counts are indicated in Tables C, D, E and F below. Survival fractions are expressed as D values (the time taken to reduce survivor fraction by one log under given conditions) estimated using data as described in results. Estimates were either made at the 60 second time point by noting the log reduction in viable spores or by graphing on semi-log paper (when several time points with residual spores were available).

Results:

VFM Inactivation of *B. subtilis* (Please see Table C). As expected from the preliminary results, VFM spore inactivation was extremely rapid and showed time and temperature dependence. Using high spore count *B. subtilis* test strips no residual spores were detected by the time the VFM reached either 170° C. or 180° C. At 160° C. or 150° C. no residual spores were detected after samples were held for one minute or longer. Because 160° C. is a "traditional" temperature used for studies of dry heat sterilization, trials have been repeated at this temperature several times. In three to four independent runs, no residual spores were detected after treating samples for one minute or longer. There is some variability of inactivation at the 0 time point (the point at which the VFM just reaches the set-point temperature) with between $10^6$ and no detectable viable spores being found in four replicates). This scatter may result from (1) variability in power/temperature profiles as a cold VFM achieves operating temperature (as is demonstrated by the variability in total cycle time (Table C)), (2) the relatively rapid spore inactivation kinetics and/or (3) from Nortech sensor variation in early runs. Process aspects are currently being studied by the engineering group of Lambda Technologies, Inc. From an anti-terrorism point of view, the short inactivation times afforded by high temperatures have obvious advantages. Only minor paper browning was noted even during the 180° C. run. From a mechanistic point of view, accurate determination of D values is critical as is the ability to produce "damaged" but viable spores. For such studies, operating temperatures of lower than 150° C. are likely to be optimal.

Using the above data, conservative estimates were made of D values for *B. subtilis* inactivation. It was assumed that (1) the VFM instantaneously achieves operating temperature and that (2) we can only detect a maximum inactivation of $10^8$ spores since 1 spore/plate would be equivalent to ten residual spores on the test strip). These assumptions result in $D_{170}$ and $D_{180}$ values of about 10–11 seconds or less (79 seconds & 88 seconds to kill 8 logs of spores). $D_{160}$ determined using the one minute treatment time is 18 seconds or less. If one omits the $10^6$ residual spore data point as an outlier a reasonable graphical fit is obtained with a $D_{160}$ of 17 seconds. A similar analysis of $D_{150}$ determined at the 60 second point is yields about 17 seconds with a graph derived value of about 22 seconds. Because inactivation is rapid versus the temperature rise in the VFM device these values must be considered as estimates. Clearly, even 14 log kills could be achieved in reasonable times using the VFM device (2.6 minutes or less at 170° C., 4.2 minutes or less at 160° C.) based on the above conservative assumptions.

Figure 11:
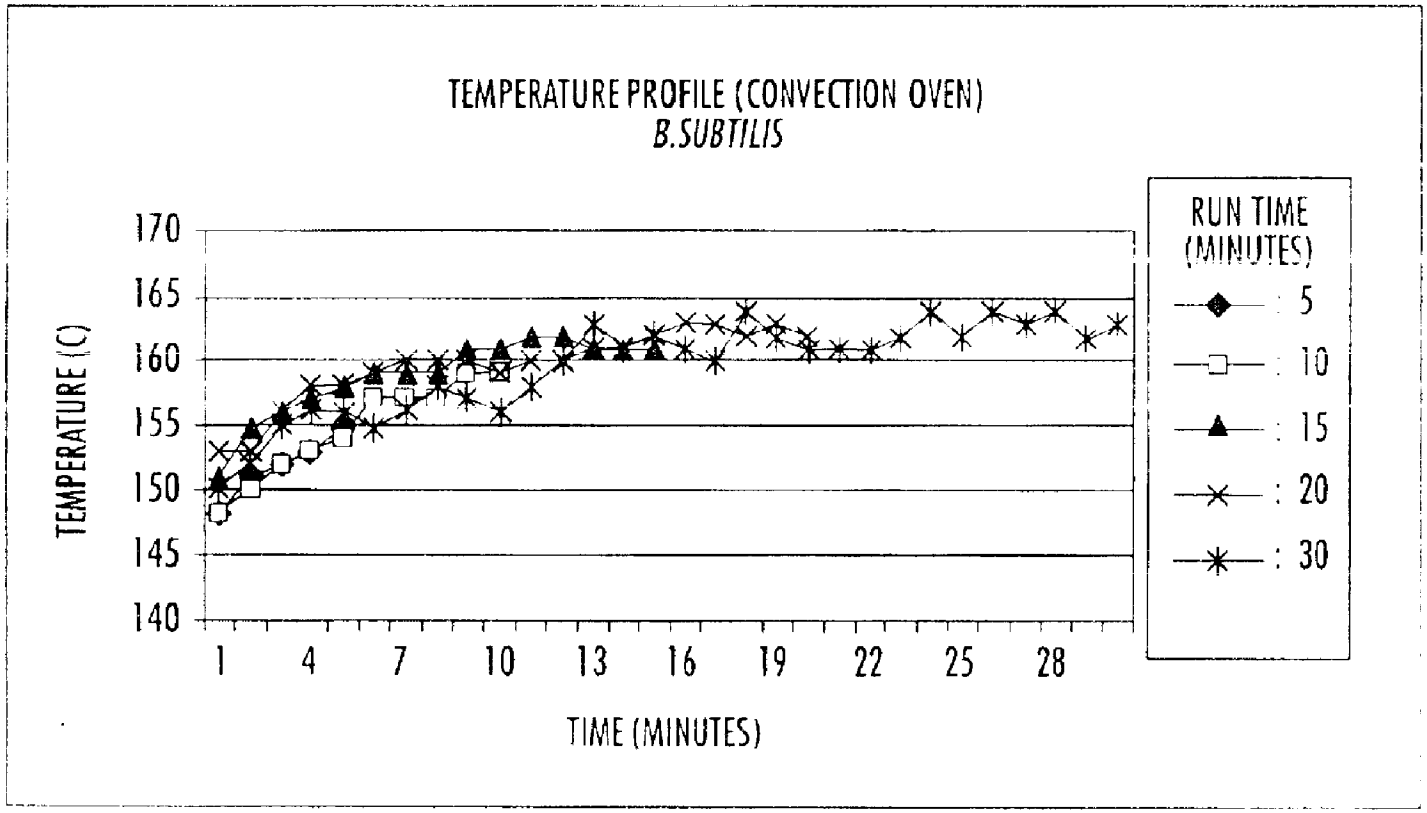
FIG. 11 is a graph that illustrates temperature profiles measured inside test mail pieces being processed in accordance with embodiments of the present invention.

Inactivation of *B. subtilis* by Heated Air: (Please see Table E). For comparison, the D value of the *B. subtilis* spore test strip was determined in a convection oven. Although the plateau temperature of the oven was between 162° C.–163° C., the recovery time was about 10 minutes (see FIG. 11 which gives temperature profiles measured inside the test mail package). Hence, we are determining a $D_{\text{"150-160"}}$. Estimates based on a minimum of 8 logs of kill in 20 minutes (or based on graphical determination) give a value of about 2.5 minutes. This compares well with the certified value of $D_{160}$ of 1.8 minutes provided by the manufacturer. This supports the VFM device being at least 7–8 fold faster in inactivating *B subtilis* spores than conventional dry hot air at comparable temperatures.

VFM Inactivation of *B. anthracis*: (Please see Table D). The effect of VFM treatment on *B. anthracis* spores was investigated to confirm that initial findings could be generalized to other spore forming bacteria. Test strips containing about $1.\times10^6$ spores derived from a commercial live spore veterinary vaccine were used in these studies. Results were similar to those observed with *B. subtilis* spores in that treatment of spores for periods of 30 second or longer at temperatures between 170° C. and 130° C. left no detectable residual viable spores. This corresponds to D values of less than 18–21 seconds determined at the 30 second time point. As was the case with *B. subtilis*, the "0" second time point appeared to show variability in that residual spores were detected in one of two runs at 160° C. and also at 140° C. At lower temperatures, residual spores could be detected for up to 2 minutes (100° C. run) and one minute (120° C. run).

Inactivation of *B. anthracis* by Heated Air: (Please see Table F). The $D_{\text{"150-160"}}$ value of *B. anthracis* was determined as for *B. subtilis*. The same oven was used resulting in essentially identical temperature profiles (not shown). Residual spores were detected only in the sample treated for 5 minutes leading to an estimated $D_{\text{"150–160"}}$ of about 2.9 minutes (a 1.7 log reduction in 5 minutes). As with *B. subtilis*, VFM appears to be at least 8 fold faster than dry hot air in inactivating *B. anthracis* (Sterne strain).

TABLE C

Summary of Results of VFM Treatment of *B. subtilis*[1]

| Target Temp. (° C.) | Time @ Target Temp. (seconds) | Final Outer Temperature (° C.) | Total Cycle Time (seconds) | Spore Count[2] |
|---|---|---|---|---|
| N/A[3] | 120–240 | 29–33 | N/A | $1.5 \times 10^9$ |
| 150 | 0 | 124 | 79 | $1.2 \times 10^3$ |
| | | | | (0.1) |
| | 30 | 118 | 104 | $4.7 \times 10^2$ |
| | | | | (0.6) |
| | 60 | 116 | 133 | <10 |
| | 120 | 121 | 196 | <10 |
| | 240 | 113 | 311 | <10 |
| 160 | 0 | 140 | 81 | $1.3 \times 10^3$ |
| | | 149 | 73 | (0.3) |
| | | 152 | 70 | $4.5 \times 10^3$ |
| | | 121 | 82 | (1.3) |
| | | | | $1.0 \times 10^6$ |
| | | | | (0.2)[4] |
| | | | | <10 |
| | 30 | 132 | 97 | $7.0 \times 10^1$ |
| | | 121 | 115 | (1.0)[4] |
| | | | | <10 |
| | 60 | 131 | 138 | <10 |
| | | 133 | 134 | <10 |
| | | 121 | 126 | <10 |
| | | 118 | 141 | <10 |
| | 120 | 121 | 197 | <10 |
| | | 141 | 196 | <10 |
| | | 120 | 178 | <10 |
| | 240 | 138 | 319 | <10 |
| | | 128 | 313 | <10 |
| | | 137 | 311 | <10 |
| 170 | 0 | 152 | 79 | <10 |
| | 30 | 152 | 111 | <10 |
| | 60 | 121 | 128 | <10 |
| 180 | 0 | 160 | 88 | <10 |
| | 30 | 154 | 98 | <10 |
| | 60 | 154 | 151 | <10 |

[1]All runs with VFM at 400 watts, center frequency of 6.43 GHz and bandwidth of 1.15 GHz.

[2]Residual spore counts were determined as described in text. Data is mean (standard deviation) of three (italics indicates two in some preliminary runs) pour plates. <10 indicates that no colonies were detected in undiluted disaggregated spore strip.

[3]All runs included untreated controls kept for two to four minutes in the un-powered machine. The range of values was $1.1–1.7 \times 10^9$ for this set of runs.

[4]These points both derive from the same run (06). The untreated control was $1.6 \times 10^9$ for this run.

TABLE D

Summary of Results of VFM Treatment of *B. anthracis*[1]

| Target Temp. (° C.) | Time @ Target Temp. (seconds) | Final Outer Temperature (° C.) | Total Cycle Time (seconds) | Spore Count[2] |
|---|---|---|---|---|
| N/A[3] | 120–240 | 29–33 | N/A | $1.1 \times 10^6$ (batch 1) $0.9 \times 10^6$ (batch 2) |
| 100 | 0 | 88 | 39 | $2.7 \times 10^5$ (0.2) |
| | 30 | 79 | 66 | $4.0 \times 10^5$ (0.4) |
| | 60 | 80 | 96 | $3.4 \times 10^5$ (0.6) |
| | 120 | 74 | 156 | $2.3 \times 10^5$ (0.7) |
| 120 | 30 | 96 | 83 | $1.7 \times 10^3$ (1.5) |
| | 60 | 99 | 108 | $2.1 \times 10^3$ (0.1) |
| | 120 | 102 | 168 | <10 |
| 130 | 0 | 111 | 56 | <10 |
| | 30 | 109 | 95 | <10 |
| | 60 | 99 | 114 | <10 |
| | 120 | 92 | 171 | <10 |
| 140 | 0 | 106 | 62 | $8.7 \times 10^1$ (2) |
| | 30 | 106 | 89 | <10 |
| | 60 | 114 | 123 | <10 |
| 150 | 0 | 121 | 73 | <10 |
| | 30 | 112 | 95 | <10 |
| | 60 | 114 | 131 | <10 |
| | 120 | 113 | 180 | <10 |
| 160 | 0 | 118 | 66 | <10 |
| | 0 | 129 | 70 | $1.8 \times 10^2$ (1) |
| | 30 | 121 | 95 | <10 |
| | 60 | 121 | 128 | <10 |
| | 120 | 122 | 185 | <10 |
| 170 | 0 | 124 | 73 | <10 |
| | 30 | 124 | 105 | <10 |
| | 60 | 116 | 128 | <10 |

[1]All runs with VFM at 400 watts, center frequency of 6.43 GHz and bandwidth of 1.15 GHz.
[2]Residual spore counts were determined as described in text. Data is mean of three plates (standard deviation). <10 indicates that no colonies were detected in undiluted disaggregated spore strip.
[3]The run included untreated controls kept for two to four minutes in the un-powered machine. The range of values was $1.7–0.7 \times 10^6$ across both batches. The run at 120° C. had the lowest control count.

TABLE E

Summary of Results of Convection Oven Treatment of *B. subtilis*

| Target Temp. (° C.) | Time in Oven (minutes) | Final Outer (Airstream) Temperature (° C.) | Final Inner (Package) Temperature (° C.) | Spore Count[1] |
|---|---|---|---|---|
| N/A[2] | N/A | 24 | N/A | $1.5 \times 10^9$ |
| 160 | 5 | 156 | 155 | $1.4 \times 10^9$ (0.2) |
| | 10 | 158 | 159 | $2.3 \times 10^8$ (0.1) |
| | 15 | 159 | 161 | $8.0 \times 10^4$ (1.0) |
| | 20 | 161 | 162 | <10 |
| | 30 | 158 | 162 | <10 |

[1]Residual spore counts were determined as described in text. Data is mean (standard deviation) of three pour plates. <10 indicates that no colonies were detected in undiluted disaggregated spore strip.
[2]The run included untreated controls kept for thirty minutes at room temperature. The value was $1.6 \times 10^9$ (0.1) for this run.

TABLE F

Summary of Results of Convection Oven Treatment of *B. anthracis*

| Target Temp. (° C.) | Time in Oven (minutes) | Final Outer (Airstream) Temperature (° C.) | Final Inner (Package) Temperature (° C.) | Spore Count[1] |
|---|---|---|---|---|
| N/A[2] | N/A | 24 | N/A | $0.9 \times 10^6$ |
| 160 | 5 | 155 | 153 | $1.8 \times 10^4$ (0.3) |
| | 10 | 157 | 160 | <10 |
| | 15 | 160 | 163 | <10 |
| | 20 | 160 | 163 | <10 |
| | 30 | 159 | 162 | <10 |

[1]Residual spore counts were determined as described in text. Data is mean (standard deviation) of three pour plates. <10 indicates that no colonies were detected in undiluted disaggregated spore strip.
[2]The run included untreated controls kept for thirty minutes at room temperature. The value was $1.1 \times 10^6$ (0.1) for this run.

Mail Processing Systems

Figure 9:
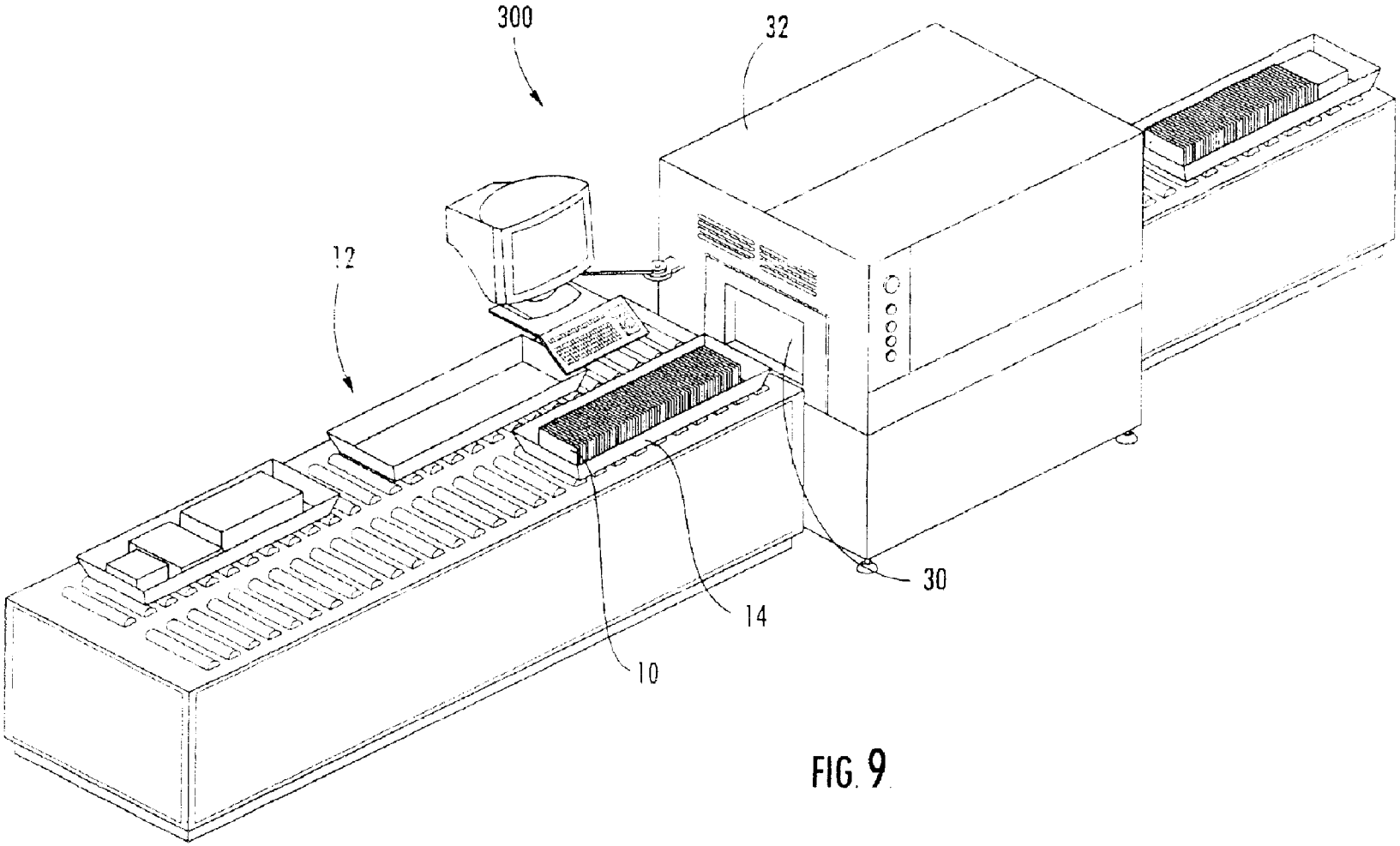
FIGS. 9–10 are perspective views of respective mail processing systems incorporating a pathogen neutralizing system according to embodiments of the present invention.
Figure 10:
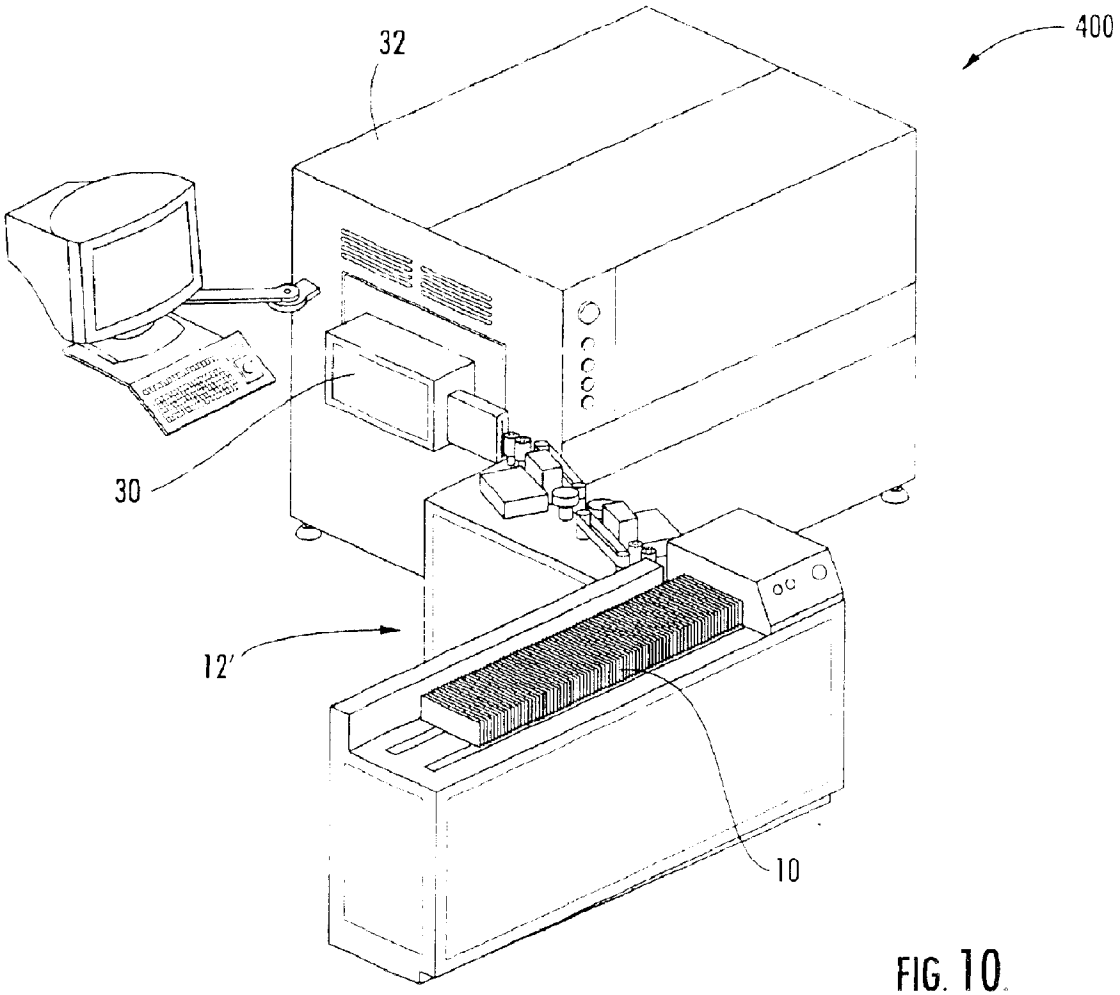

FIGS. 9–10 illustrate respective mail processing systems 300, 400 that incorporate a pathogen neutralizing system according to embodiments of the present invention. In FIG. 9, a conveyor 12 is configured to convey mail pieces 10 held in a tray through a variable frequency microwave furnace 32. In FIG. 10, a conveyor 12' is configured to convey mail pieces 10 in single file order through a variable frequency microwave furnace 32. Mail processing systems 300, 400 for conveying mail pieces, either in bulk via trays, or in single file fashion, are well known to those skilled in the art and need not be described herein. Embodiments of the present invention may be combined easily and inexpensively with any and all types of mail processing and handling systems, without limitation.

Figure 12:
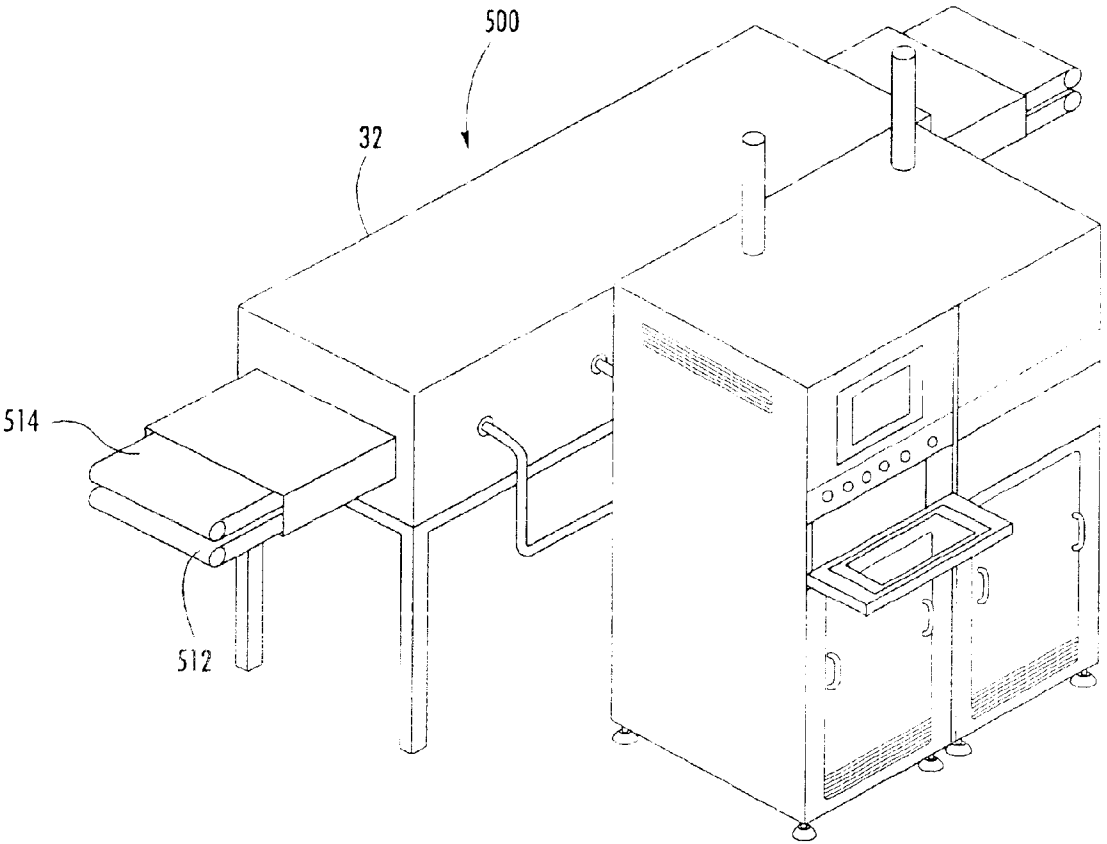
FIG. 12 is a perspective view of a mail processing system incorporating a pathogen neutralizing system according to embodiments of the present invention.
Figure 13:
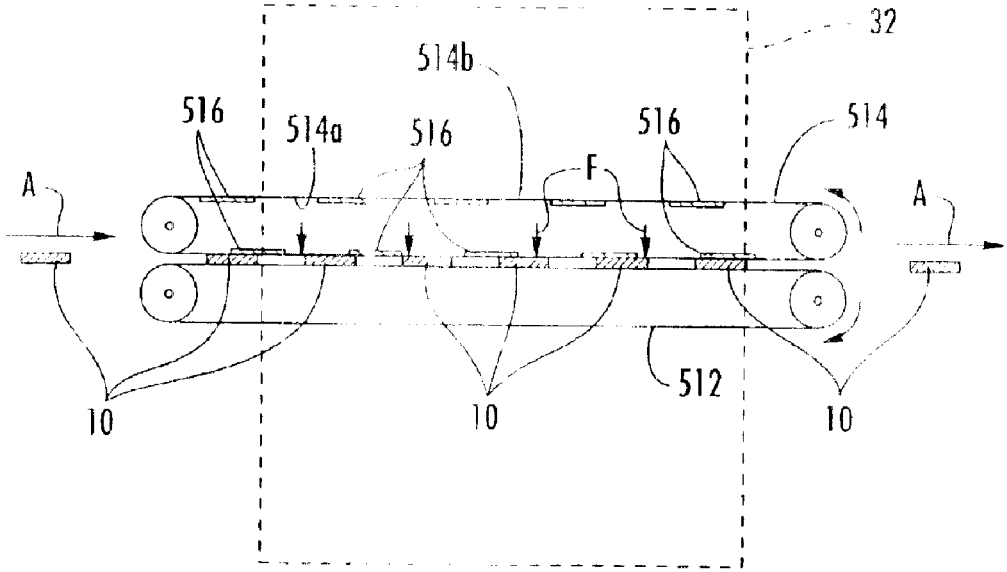
FIG. 13 is a side view of the mail processing system of FIG. 12 illustrating the first and second conveyors, wherein the first conveyor advances mail pieces along a direction and wherein the second conveyor applies a compressive force to the mail pieces.

Referring to FIGS. 12–13, a dual-conveyor mail processing system 500, according to embodiments of the present invention, is illustrated. The illustrated mail processing system 500 includes first and second conveyor belts 512, 514 that are configured to convey mail pieces 10 through a variable frequency microwave furnace 32. The first conveyor belt 512 is generally horizontal and is configured to convey mail pieces 10 disposed thereon in the direction indicated by arrow A. The second conveyor belt 514 provides a slight compression force (indicated by force arrows F) to the mail pieces 10 on the first conveyor belt 512 as illustrated in FIG. 13.

The second conveyor belt 514 includes microwave susceptor material 516, either integrally formed with the second conveyor belt 514, or disposed within or on a surface of the second conveyor belt 514. The microwave susceptor material 516 is configured to heat in the presence of microwave energy and direct heat to the mail pieces 10 on the first conveyor belt 512. The microwave susceptor material 516 also is configured to even out the thermal distribution that may occur in a non-homogenous mail stream.

In the illustrated embodiment, microwave susceptor material 516 is disposed on the unexposed surface 514*a* of the second conveyor belt 514. However, it is understood that the microwave susceptor material 516 may be disposed on the exposed surface 514*b* of the second conveyor belt 514 and/or within the material of the second conveyor belt 514.

The first and second conveyor belts 512, 514 are preferably transparent to microwave energy. In the presence of microwave energy within variable frequency microwave furnace 32, the susceptor material heats to a temperature of between about 60° C. and about 190° C.

Embodiments of the present invention are not limited to the conveyor configuration of FIGS. 12–13. For example, the first and second conveyor belts 512, 514 may have a generally vertical, or otherwise non-horizontal, orientation.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A method of neutralizing pathogen-contaminated mail pieces, comprising sweeping each mail piece with at least one range of microwave frequencies selected to neutralize pathogens contained within the mail piece without harming the mail piece and contents thereof, and wherein sweeping each mail piece with at least one range of microwave frequencies comprises passing each mail piece adjacent to a microwave diffuser plate positioned between the mail piece and a source of the at least one range of microwave frequencies, wherein the diffuser plate includes an array of apertures formed therein that facilitates even distribution of microwave energy.

2. The method of claim 1, further comprising heating each mail piece to a predetermined temperature prior to sweeping with the at least one range of microwave frequencies.

3. The method of claim 2, wherein the predetermined temperature is between about 60° C. and about 190° C.

4. The method of claim 2, wherein the heating step comprises passing each mail piece adjacent to a heat source.

5. The method of claim 1, further comprising irradiating each mail piece with radiation from a radiation source to neutralize pathogens on the mail piece .

6. The method of claim 5, wherein the radiation source is a UV light source.

7. The method of claim 5, wherein the radiation source is a plasma generator.

8. The method of claim 7, wherein temperature monitoring is performed via a temperature sensor in contact with each mail piece.

9. The method of claim 7, wherein temperature monitoring is performed via an infrared sensor.

10. The method of claim 1, further comprising:

monitoring the temperature of each mail piece being swept with at least one range of microwave frequencies;

removing mail pieces having a temperature above a predetermined threshold; and screening the removed mail pieces for hazardous contents.

11. The method of claim 1, wherein the at least one range of microwave frequencies is a plurality of ranges of microwave frequencies.

12. The method of claim 1, wherein the at least one range of microwave frequencies has a central frequency selected to disrupt a helix strand of a nucleic acid of the pathogen.

13. The method of claim 1, wherein the at least one range of microwave frequencies has a central frequency selected to modify a capsid enclosing a nucleic acid of the pathogen.

14. The method of claim 1, wherein the at least one range of microwave frequencies has a central frequency selected to selectively couple with water molecules inside a capsid enclosing a nucleic acid of the pathogen to disrupt the nucleic acid.

15. The method of claim 1, wherein the pathogen comprises anthrax spores.

16. The method of claim 1, wherein the pathogen comprises smallpox.

17. A system for neutralizing pathogen-contaminated mail pieces, comprising:

a conveyor for advancing a plurality of mail pieces along a first direction; a variable frequency microwave source operably associated with the conveyor and configured to sweep each mail piece on the conveyor with at least one range of microwave frequencies selected to neutralize pathogens contained within a mail piece without harming the mail piece and contents thereof; and a microwave diffuser plate positioned between the conveyor and the variable frequency microwave source, wherein the diffuser plate includes an array of apertures formed therein that facilitates even distribution of microwave energy from the variable frequency microwave source.

18. The system of claim 17, further comprising a heat source operably associated with the conveyor that is configured to heat mail pieces on the conveyor to a predetermined temperature prior to being swept with the at least one range of microwave frequencies.

19. The system of claim 18, wherein the predetermined temperature is between about 60° C. and about 190° C.

20. The system of claim 18, wherein the heat source is selected from the group consisting of resistance heaters, heated air convection systems, microwave absorbing susceptors, and microwave absorbing diffuser plates.

21. The system of claim 17, further comprising a radiation source operably associated with the conveyor that is configured to irradiate each mail piece to neutralize pathogens on the mail piece.

22. The system of claim 21, wherein the radiation source comprises a UV light source.

23. The system of claim 21, wherein the radiation source comprises a plasma generator.

24. The system of claim 17, further comprising:

a temperature sensor configured to measure the temperature of each mail piece being swept with the at least one range of microwave frequencies;

means for removing mail pieces from the conveyor that have a temperature above a predetermined threshold; and means for screening the removed mail pieces for hazardous contents.

25. The system of claim 24, wherein the temperature sensor comprises a sensor selected from the group consisting of infrared sensors, optical sensors, and thermocouples.

26. The system of claim 17, wherein the at least one range of microwave frequencies is a plurality of ranges of microwave frequencies.

27. The system of claim 17, wherein the pathogen comprises anthrax spores.

28. The system of claim 17, wherein the pathogen comprises smallpox.

29. A method of processing a plurality of mail pieces for delivery to respective destinations, comprising:

removing mail pieces having suspicious characteristics from the plurality of mail pieces;

sweeping each remaining mail piece with at least one range of microwave frequencies selected to neutralize a pathogen contained therewithin without harming the mail piece or the contents thereof;

monitoring the temperature of each mail piece being swept with the at least one range of microwave frequencies; and removing mail pieces having a temperature above a predetermined threshold.

30. The method of claim 29, further comprising screening mail pieces removed from the plurality of mail pieces for hazardous contents.

31. The method of claim 29, further comprising heating each mail piece to a predetermined temperature prior to sweeping with the at least one range of microwave frequencies.

32. The method of claim 31, wherein the predetermined temperature is between about 60° C. and about 190° C.

33. The method of claim 31, wherein the heating step comprises passing each mail piece adjacent to a heat source.

34. The method of claim 31, wherein sweeping each mail piece with at least one range of microwave frequencies comprises passing each mail piece adjacent to a microwave diffuser plate positioned between the mail piece and a source of the at least one range of microwave frequencies, wherein the diffuser plate includes an array of apertures formed therein that facilitates even distribution of microwave energy.

35. The method of claim 29, further comprising irradiating each mail piece with radiation from a radiation source to neutralize pathogens on the mail piece.

36. The method of claim 35, wherein the radiation source is a UV light source.

37. The method of claim 35, wherein the radiation source is a plasma generator.

38. The method of claim 29, wherein temperature monitoring is performed via a temperature sensor in contact with each mail piece.

39. The method of claim 29, wherein temperature monitoring is performed via an infrared sensor.

40. The method of claim 29, wherein the at least one range of microwave frequencies is a plurality of ranges of microwave frequencies.

41. The method of claim 29, wherein the at least one range of microwave frequencies has a central frequency selected to disrupt a helix strand of a nucleic acid of the pathogen.

42. The method of claim 29, wherein the at least one range of microwave frequencies has a central frequency selected to modify a capsid enclosing a nucleic acid of the pathogen.

43. The method of claim 29, wherein the at least one range of microwave frequencies has a central frequency selected to selectively couple with water molecules inside a capsid enclosing a nucleic acid of the pathogen to disrupt the nucleic acid.

44. The method of claim 29, wherein the pathogen comprises anthrax spores.

45. The method of claim 29, wherein the pathogen comprises smallpox.

46. A method of neutralizing pathogen-contaminated mail pieces, comprising:

sweeping each mail piece with at least one range of microwave frequencies selected to neutralize pathogens contained within the mail piece without harming the mail piece and contents thereof;

irradiating each mail piece with radiation from a radiation source to neutralize pathogens on the mail piece;

monitoring the temperature of each mail piece being swept with at least one range of microwave frequencies;

removing mail pieces having a temperature above a predetermined threshold; and screening the removed mail pieces for hazardous contents.

47. The method of claim 46, wherein the radiation source is a UV light source.

48. The method of claim 46, wherein the radiation source is a plasma generator.

49. The method of claim 46, further comprising heating each mail piece to a predetermined temperature prior to sweeping with the at least one range of microwave frequencies.

50. The method of claim 49, wherein the predetermined temperature is between about 60° C. and about 190° C.

51. The method of claim 49, wherein the heating step comprises passing each mail piece adjacent to a heat source.

52. The method of claim 46, wherein sweeping each mail piece with at least one range of microwave frequencies comprises passing each mail piece adjacent to a microwave diffuser plate positioned between the mail piece and a source of the at least one range of microwave frequencies, wherein the diffuser plate includes an array of apertures formed therein that facilitates even distribution of microwave energy.

53. The method of claim 46, wherein temperature monitoring is performed via a temperature sensor in contact with each mail piece.

54. The method of claim 46, wherein temperature monitoring is performed via an infrared sensor.

55. The method of claim 46, wherein the at least one range of microwave frequencies is a plurality of ranges of microwave frequencies.

56. The method of claim 46, wherein the at least one range of microwave frequencies has a central frequency selected to disrupt a helix strand of a nucleic acid of the pathogen.

57. The method of claim 46, wherein the at least one range of microwave frequencies has a central frequency selected to modify a capsid enclosing a nucleic acid of the pathogen.

58. The method of claim 46, wherein the at least one range of microwave frequencies has a central frequency selected to selectively couple with water molecules inside a capsid enclosing a nucleic acid of the pathogen to disrupt the nucleic acid.

59. The method of claim 46, wherein the pathogen comprises anthrax spores.

60. The method of claim 46, wherein the pathogen comprises smallpox.

61. A method of neutralizing pathogen-contaminated mail pieces, comprising:

sweeping each mail piece with at least one range of microwave frequencies selected to neutralize pathogens contained within the mail piece without harming the mail piece and contents thereof;

monitoring the temperature of each mail piece being swept with at least one range of microwave frequencies;

removing mail pieces having a temperature above a predetermined threshold; and screening the removed mail pieces for hazardous contents.

62. The method of claim 61, further comprising heating each mail piece to a predetermined temperature prior to sweeping with the at least one range of microwave frequencies.

63. The method of claim 62, wherein the predetermined temperature is between about 60° C. and about 190° C.

64. The method of claim 62, wherein the heating step comprises passing each mail piece adjacent to a heat source.

65. The method of claim 61, wherein sweeping each mail piece with at least one range of microwave frequencies comprises passing each mail piece adjacent to a microwave diffuser plate positioned between the mail piece and a source of the at least one range of microwave frequencies, wherein the diffuser plate includes an array of apertures formed therein that facilitates even distribution of microwave energy.

66. The method of claim 61, further comprising irradiating each mail piece with radiation from a radiation source to neutralize pathogens on the mail piece.

67. The method of claim 66, wherein the radiation source is a UV light source.

68. The method of claim 66, wherein the radiation source is a plasma generator.

69. The method of claim 61, wherein temperature monitoring is performed via a temperature sensor in contact with each mail piece.

70. The method of claim 61, wherein temperature monitoring is performed via an infrared sensor.

71. The method of claim 61, wherein the at least one range of microwave frequencies is a plurality of ranges of microwave frequencies.

72. The method of claim 61, wherein the at least one range of microwave frequencies has a central frequency selected to disrupt a helix strand of a nucleic acid of the pathogen.

73. The method of claim 61, wherein the at least one range of microwave frequencies has a central frequency selected to modify a capsid enclosing a nucleic acid of the pathogen.

74. The method of claim 61, wherein the at least one range of microwave frequencies has a central frequency selected to selectively couple with water molecules inside a capsid enclosing a nucleic acid of the pathogen to disrupt the nucleic acid.

75. The method of claim 61, wherein the pathogen comprises anthrax spores.

76. The method of claim 61, wherein the pathogen comprises smallpox.

77. A method of neutralizing pathogen-contaminated mail pieces, comprising sweeping each mail piece with a plurality of ranges microwave frequencies selected to neutralize pathogens contained within the mail piece without harming the mail piece and contents thereof, wherein the plurality of ranges of microwave frequencies have a central frequency selected to disrupt a helix strand of a nucleic acid of the pathogen.

78. The method of claim 77, further comprising heating each mail piece to a predetermined temperature prior to sweeping with the at least one range of microwave frequencies.

79. The method of claim 78, wherein the predetermined temperature is between about 60° C. and about 190° C.

80. The method claim 78, wherein the heating step comprises passing each mail piece adjacent to a heat source.

81. The method of claim 77, wherein sweeping each mail piece with at least one range of microwave frequencies comprises passing each mail piece adjacent to a microwave diffuser plate positioned between the mail piece and a source of the at least one range of microwave frequencies, wherein the diffuser plate includes an array of apertures formed therein that facilitates even distribution of microwave energy.

82. The method of claim 77, further comprising irradiating each mail piece with radiation from a radiation source to neutralize pathogens on the mail piece.

83. The method of claim 82, wherein the radiation source is a UV light source.

84. The method of claim 82, wherein the radiation source is a plasma generator

85. The method of claim 77, further comprising:

monitoring the temperature of each mail piece being swept with at least one range of microwave frequencies;

removing mail pieces having a temperature above a predetermined threshold; and screening the removed mail pieces for hazardous contents.

86. The method of claim 85, wherein temperature monitoring is performed via a temperature sensor in contact with each mail piece.

87. The method of claim 85, wherein temperature monitoring is performed via an infrared sensor.

88. The method of claim 77, wherein the at least one range of microwave frequencies has a central frequency selected to modify a capsid enclosing a nucleic acid of the pathogen.

89. The method of claim 77, wherein the at least one range of microwave frequencies has a central frequency selected to selectively couple with water molecules inside a capsid enclosing a nucleic acid of the pathogen to disrupt the nucleic acid.

90. The method of claim 77, wherein the pathogen comprises anthrax spores.

91. The method of claim 77, wherein the pathogen comprises smallpox.

92. A method of neutralizing pathogen-contaminated mail pieces, comprising sweeping each mail piece with at least one range of microwave frequencies selected to neutralize pathogens contained within the mail piece without harming the mail piece and contents thereof, wherein the at least one range of microwave frequencies has a central frequency selected to disrupt a helix strand of a nucleic acid of the pathogen.

93. The method of claim 92, wherein the pathogen comprises anthrax spores.

94. The method of claim 92, wherein the pathogen comprises smallpox.

95. A method of neutralizing pathogen-contaminated mail pieces, comprising sweeping each mail piece with at least one range of microwave frequencies selected to neutralize pathogens contained within the mail piece without harming the mail piece and contents thereof, wherein the at least one range of microwave frequencies has a central frequency selected to modify a capsid enclosing a nucleic acid of the pathogen.

96. The method of claim 95, wherein the pathogen comprises anthrax spores.

97. The method of claim 95, wherein the pathogen comprises smallpox.

98. A method of neutralizing pathogen-contaminated mail pieces, comprising sweeping each mail piece with at least one range of microwave frequencies selected to neutralize pathogens contained within the mail piece without harming the mail piece and contents thereof, wherein the at least one range of microwave frequencies has a central frequency selected to selectively couple with water molecules inside a capsid enclosing a nucleic acid of the pathogen to disrupt the nucleic acid.

99. The method of claim 98, wherein the pathogen comprises anthrax spores.

100. The method of claim 98, wherein the pathogen comprises smallpox.

101. A system for neutralizing pathogen-contaminated mail pieces, comprising:

a conveyor for advancing a plurality of mail pieces along a first direction;

a variable frequency microwave source operably associated with the conveyor and configured to sweep each mail piece on the conveyor with at least one range of microwave frequencies selected to neutralize pathogens contained within a mail piece without harming the mail piece and contents thereof;

a plasma generator operably associated with the conveyor that is configured to irradiate each mail piece to neutralize pathogens on the mail piece.

102. The system of claim 101, further comprising a heat source operably associated with the conveyor that is configured to heat mail pieces on the conveyor to a predetermined temperature prior to being swept with the at least one range of microwave frequencies.

103. The system of claim 102, wherein the predetermined temperature is between about 60° C. and about 190° C.

104. The system of claim 102, wherein the heat source is selected from the group consisting of resistance heaters, heated air convection systems, microwave absorbing susceptors, and microwave absorbing diffuser plates.

105. The system of claim 101, further comprising a microwave diffuser plate positioned between the conveyor and the variable frequency microwave source, wherein the diffuser plate includes an array of apertures formed therein that facilitates even distribution of microwave energy from the variable frequency microwave source.

106. The system of claim 101, further comprising:

a temperature sensor configured to measure the temperature of each mail piece being swept with the at least one range of microwave frequencies;

means for removing mail pieces from the conveyor that have a temperature above a predetermined threshold; and means for screening the removed mail pieces for hazardous contents.

107. The system of claim 106, wherein the temperature sensor comprises a sensor selected from the group consisting of infrared sensors, optical sensors, and thermocouples.

108. The system of claim 101, wherein the at least one range of microwave frequencies is a plurality of ranges of microwave frequencies.

109. The system of claim 101, wherein the pathogen comprises anthrax spores.

110. The system of claim 101, wherein the pathogen comprises smallpox.

111. A system for neutralizing pathogen-contaminated mail pieces, comprising:

a conveyor for advancing a plurality of mail pieces along a first direction;

a variable frequency microwave source operably associated with the conveyor and configured to sweep each mail piece on the conveyor with at least one range of microwave frequencies selected to neutralize pathogens contained within a mail piece without harming the mail piece and contents thereof;

a temperature sensor configured to measure the temperature of each mail piece being swept with the at least one range of microwave frequencies;

means for removing mail pieces from the conveyor that have a temperature above a predetermined threshold; and means for screening the removed mail pieces for hazardous contents.

112. The system of claim 111, further comprising a heat source operably associated with the conveyor that is configured to heat mail pieces on the conveyor to a predetermined temperature prior to being swept with the at least one range of microwave frequencies.

113. The system of claim 112, wherein the heat source is selected from the group consisting of resistance heaters, heated air convection systems, microwave absorbing susceptors, and microwave absorbing diffuser plates.

114. The system of claim 112, wherein the heat predetermined temperature is between about 60° C. and about 190° C.

115. The system of claim 111, further comprising a microwave diffuser plate positioned between the conveyor and the variable frequency microwave source, wherein the diffuser plate includes an array of apertures formed therein that facilitates even distribution of microwave energy from the variable frequency microwave source.

116. The system of claim 111, further comprising a radiation source operably associated with the conveyor that is configured to irradiate each mail piece to neutralize pathogens on the mail piece.

117. The system of claim 116, wherein the radiation source comprises a UV light source.

118. The system of claim 116, wherein the radiation source comprises a plasma generator.

119. The system of claim 111, wherein the temperature sensor comprises a sensor selected from the group consisting of infrared sensors, optical sensors, and thermocouples.

120. The system of claim 111, wherein the at least one range of microwave frequencies is a plurality of ranges of microwave frequencies.

121. The system of claim 111, wherein the pathogen comprises anthrax spores.

122. The system of claim 111, wherein the pathogen comprises smallpox.

123. A system for neutralizing pathogen-contaminated mail pieces, comprising:

a conveyor for advancing a plurality of mail pieces along a first direction;

a variable frequency microwave source operably associated with the conveyor and configured to sweep each mail piece on the conveyor with a plurality of ranges of microwave frequencies selected to neutralize pathogens contained within a mail piece without harming the mail piece and contents thereof; and a heat source operably associated with the conveyor that is configured to heat mail pieces on the conveyor to a predetermined temperature prior to being swept with the at least one range of microwave frequencies.

124. The system of claim 123, wherein the predetermined temperature is between about 60° C. and about 190° C.

125. The system of claim 123, wherein the heat source is selected from the group consisting of resistance heaters, heated air convection systems, microwave absorbing susceptors, and microwave absorbing diffuser plates.

126. The system of claim 123, further comprising a microwave diffuser plate positioned between the conveyor and the variable frequency microwave source, wherein the diffuser plate includes an array of apertures formed therein that facilitates even distribution of microwave energy from the variable frequency microwave source.

127. The system of claim 123, further comprising a radiation source operably associated with the conveyor that is configured to irradiate each mail piece to neutralize pathogens on the mail piece.

128. The system of claim 127, wherein the radiation source comprises a UV light source.

129. The system of claim 127, wherein the radiation source comprises a plasma generator.

130. The system of claim 123, further comprising:

a temperature sensor configured to measure the temperature of each mail piece being swept with the at least one range of microwave frequencies;

means for removing mail pieces from the conveyor that have a temperature above a predetermined threshold; and means for screening the removed mail pieces for hazardous contents.

131. The system of claim 130, wherein the temperature sensor comprises a sensor selected from the group consisting of infrared sensors, optical sensors, and thermocouples.

132. The system of claim 123, wherein the pathogen comprises anthrax spores.

133. The system of claim 123, wherein the pathogen comprises smallpox.

134. A method of neutralizing pathogen-contaminated mail pieces, comprising:

sweeping each mail piece with at least one range of microwave frequencies selected to neutralize pathogens contained within the mail piece without harming the mail piece and contents thereof, wherein the at least one range of microwave frequencies has a central frequency selected to disrupt a helix strand of a nucleic acid of the pathogen; and irradiating each mail piece with radiation from a radiation source to neutralize pathogens on the mail piece.

135. A method of neutralizing pathogen-contaminated mail pieces, comprising:

sweeping each mail piece with at least one range of microwave frequencies selected to neutralize pathogens contained within the mail piece without harming the mail piece and contents thereof, wherein the at least one range of microwave frequencies has a central frequency selected to modify a capsid enclosing a nucleic acid of the pathogen; and irradiating each mail piece with radiation from a radiation source to neutralize pathogens on the mail piece.

136. A method of neutralizing pathogen-contaminated mail pieces, comprising:

sweeping each mail piece with at least one range of microwave frequencies selected to neutralize pathogens contained within the mail piece without harming the mail piece and contents thereof, wherein the at least one range of microwave frequencies has a central frequency selected to selectively couple with water molecules inside a capsid enclosing a nucleic acid of the pathogen to disrupt the nucleic acid; and irradiating each mail piece with radiation from a radiation source to neutralize pathogens on the mail piece.

137. A method of neutralizing pathogen-contaminated mail pieces, comprising sweeping each mail piece with a plurality of ranges microwave frequencies selected to neutralize pathogens contained within the mail piece without harming the mail piece and contents thereof, wherein the ranges of microwave frequencies have a central frequency selected to modify a capsid enclosing a nucleic acid of the pathogen.

138. A method of neutralizing pathogen-contaminated mail pieces, comprising sweeping each mail piece with a plurality of ranges microwave frequencies selected to neutralize pathogens contained within the mail piece without harming the mail piece and contents thereof, wherein the ranges of microwave frequencies have a central frequency selected to selectively couple with water molecules inside a capsid enclosing a nucleic acid of the pathogen to disrupt the nucleic acid.

139. A system for neutralizing pathogen-contaminated mail pieces, comprising:

a conveyor for advancing a plurality of mail pieces along a first direction;

a variable frequency microwave source operably associated with the conveyor and configured to sweep each mail piece on the conveyor with a plurality of ranges of microwave frequencies selected to neutralize pathogens contained within a mail piece without harming the mail piece and contents thereof; and a radiation source operably associated with the conveyor that is configured to irradiate each mail piece to neutralize pathogens on the mail piece.

140. A system for neutralizing pathogen-contaminated mail pieces, comprising:

a conveyor for advancing a plurality of mail pieces along a first direction;

a variable frequency microwave source operably associated with the conveyor and configured to sweep each mail piece on the conveyor with a plurality of ranges of microwave frequencies selected to neutralize pathogens contained within a mail piece without harming the mail piece and contents thereof;

a temperature sensor configured to measure the temperature of each mail piece being swept with the at least one range of microwave frequencies;

means for removing mail pieces from the conveyor that have a temperature above a predetermined threshold; and means for screening the removed mail pieces for hazardous contents.

* * * * *

UNITED STATES PATENT AND TRADEMARK OFFICE

CERTIFICATE OF CORRECTION

PATENT NO. : 6,872,927 B2
DATED : March 29, 2005
INVENTOR(S) : Geisler et al.

It is certified that error appears in the above-identified patent and that said Letters Patent is hereby corrected as shown below:

Column 25,
Line 13, should read -- 34. The method of claim 29, wherein sweeping each mail --

Column 30,
Line 5, should read -- 114. The system of claim 111, wherein the predetermined --

Signed and Sealed this

Ninth Day of August, 2005

JON W. DUDAS
*Director of the United States Patent and Trademark Office*